US009528371B2

(12) United States Patent
Liu et al.

(10) Patent No.: US 9,528,371 B2
(45) Date of Patent: Dec. 27, 2016

(54) FLUID PRESSURE PULSE GENERATING APPARATUS AND METHOD OF USING SAME

(71) Applicant: Evolution Engineering Inc., Calgary (CA)

(72) Inventors: Jili Liu, Calgary (CA); David A. Switzer, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 14/770,786

(22) PCT Filed: Feb. 27, 2014

(86) PCT No.: PCT/CA2014/050138
§ 371 (c)(1),
(2) Date: Aug. 26, 2015

(87) PCT Pub. No.: WO2014/131125
PCT Pub. Date: Sep. 4, 2014

(65) Prior Publication Data

US 2016/0010449 A1 Jan. 14, 2016

Related U.S. Application Data

(60) Provisional application No. 61/769,930, filed on Feb. 27, 2013.

(51) Int. Cl.
*E21B 47/20* (2012.01)
*E21B 47/18* (2012.01)
(Continued)

(52) U.S. Cl.
CPC ..... *E21B 47/18* (2013.01); *E21B 47/00* (2013.01); *E21B 47/187* (2013.01); *F15B 21/125* (2013.01)

(58) Field of Classification Search
CPC ..... E21B 47/14; E21B 47/16; E21B 47/18; F16D 1/10; F16D 1/101; F16D 1/108; F16D 1/112
(Continued)

(56) References Cited

U.S. PATENT DOCUMENTS 3,792,429 A * 2/1974 Patton ..... E21B 47/182 367/84
5,182,731 A * 1/1993 Hoelscher ..... E21B 47/182 367/84
(Continued)

FOREIGN PATENT DOCUMENTS

CA 2 551 316 A1 12/2007
GB 2486811 A 6/2012

*Primary Examiner* — Kenneth L Thompson
(74) *Attorney, Agent, or Firm* — Seed Intellectual Property Law Group LLP

(57) ABSTRACT

A fluid pressure pulse generating apparatus including a pulser assembly and a fluid pressure pulse generator and methods of using the fluid pressure pulse generating apparatus. The pulser assembly comprises a motor, a sensor for detecting rotation of the motor, a driveshaft rotationally coupled to the motor, and processing and motor control equipment communicative with the motor and the sensor. The fluid pressure pulse generator is coupled with the driveshaft. The sensor provides an indication of the amount of rotation of the motor and this information can be processed by the processing and motor control equipment to determine the position of the driveshaft and to control rotation of the driveshaft based on a predetermined rotational relationship between the driveshaft and the motor.

11 Claims, 13 Drawing Sheets

(51) Int. Cl.
*F15B 21/12* (2006.01)
*E21B 47/00* (2012.01)

(58) Field of Classification Search
USPC ..... 181/106; 367/82.84; 340/854.4, 855.4
See application file for complete search history.

(56) References Cited

U.S. PATENT DOCUMENTS

| | | | | |
|---|---|---|---|---|
| 5,237,540 | A * | 8/1993 | Malone | E21B 47/182 175/40 |
| 6,094,401 | A * | 7/2000 | Masak | G01V 1/133 181/106 |
| 6,714,138 | B1 | 3/2004 | Turner et al. | |
| 7,280,432 | B2 * | 10/2007 | Hahn | E21B 47/18 175/48 |
| 7,735,579 | B2 * | 6/2010 | Gopalan | E21B 47/187 175/40 |
| 8,251,160 | B2 | 8/2012 | Gopalan et al. | |
| 8,474,548 | B1 * | 7/2013 | Young | E21B 47/187 175/40 |
| 2007/0002525 | A1 | 1/2007 | Yamanoi et al. | |
| 2007/0182583 | A1 | 8/2007 | Feluch | |
| 2008/0002525 | A1 | 1/2008 | Pratt et al. | |
| 2015/0247403 | A1 * | 9/2015 | Logan | E21B 47/18 175/40 |

* cited by examiner

FLUID PRESSURE PULSE GENERATING APPARATUS AND METHOD OF USING SAME

FIELD

This disclosure relates generally to downhole drilling, specifically to data acquisition and telemetry such as measurement-while-drilling (MWD), including a fluid pressure pulse generating apparatus and a method of using same.

BACKGROUND

The recovery of hydrocarbons from subterranean zones relies on the process of drilling wellbores. The process includes drilling equipment situated at surface and a drill string extending from the surface equipment to the formation or subterranean zone of interest. The drill string can extend thousands of meters below the surface. The terminal end of the drill string includes a drill bit for drilling (or extending) the wellbore. In addition to this conventional drilling equipment the system also relies on some sort of drilling fluid, which in most cases is a drilling "mud" which is pumped through the inside of the drill string. The drilling mud cools and lubricates the drill bit and then exits out of the drill bit and carries rock cuttings back to surface. The mud also helps control bottom hole pressure and prevents hydrocarbon influx from the formation into the wellbore, which can potentially cause a blow out at surface.

Directional drilling is the process of steering a well away from vertical to intersect a target endpoint or follow a prescribed path. At the terminal end of the drill string is a bottom-hole-assembly ("BHA") which comprises 1) a drill bit; 2) a steerable downhole mud motor of rotary steerable system; 3) sensors of survey equipment (logging-while-drilling (LWD) and/or measurement-while-drilling (MWD)) to evaluate downhole conditions as well depth progresses; 4) equipment for telemetry of data to surface; and 5) other control mechanisms such as stabilizers or heavy weight drill collars. The BHA is conveyed into the wellbore by a metallic tubular.

MWD equipment is used to provide downhole sensor and status information to surface in a near real time mode while drilling. This information is used by the rig crew to make decisions about controlling and steering the well to optimize drilling speed and trajectory based on numerous factors including lease boundaries, location of existing wells, formation properties, and hydrocarbon size and location. This can include making intentional deviations from an originally-planned wellbore path as necessary based on information gathered from the downhole sensors during the drilling process. The ability to obtain real time data during MWD results in a relatively more cost effective and efficient drilling operation.

Known MWD tools contain essentially the same sensor package to survey the wellbore, however the data may be sent back to surface by various telemetry methods. Such telemetry methods include, but are not limited to the use of a hardwired drill pipe, acoustic telemetry, use of a fibre optic cable, mud pulse (MP) telemetry and electromagnetic (EM) telemetry. The sensors are usually located in an electronics probe or instrumentation assembly contained in a cylindrical cover or housing located near the drill bit.

MP telemetry involves creating pressure waves in the drilling mud circulating inside the drill string. Mud circulates from surface to downhole using positive displacement pumps. The resulting flow rate of mud is typically constant.

Pressure pulses are generated by changing the flow area and/or flow path of the drilling mud as it passes the MWD tool in a timed, coded sequence, thereby creating pressure differentials in the drilling mud. The pressure pulses act to transmit data utilizing a number of encoding schemes. These schemes may include amplitude shift keying (ASK), frequency shift keying (FSK), phase shift keying (PSK), or a combination of these techniques.

The pressure differentials or pulses may be either negative pulses or positive pulses. Valves that open and close a bypass mud stream from inside the drill pipe to the wellbore annulus create a negative pressure pulse. All negative pulsing valves need a high differential pressure below the valve to create a sufficient pressure drop when the valve is open, which results in negative valves being more prone to washing. With each actuation, the valve hits against the valve seat to ensure it completely closes the bypass; this impact can lead to mechanical and abrasive wear and failure. Valves that use a controlled restriction within the circulating mud stream create a positive pressure pulse. Some positive pulsing valves are hydraulically powered to reduce the required actuation power and typically have a main valve indirectly operated by a pilot valve. The pilot valve closes a flow restriction which actuates the main valve to create a pressure pulse. Pulse frequency is typically governed by pulse generating motor speed changes. The pulse generating motor requires electrical connectivity with other elements of the MWD probe such as a battery stack and sensors.

A number of different types of valves are currently used to create positive pressure pulses. Generally, pressure pulse valves are capable of generating discrete pulses at a predetermined frequency by selective restriction of the mud flow. In a typical rotary or rotating disc valve pulser, a control circuit activates a motor (e.g. a brushless or DC electric motor) that rotates a windowed restrictor (rotor) relative to a fixed housing (stator). As the rotor rotates it moves between an open position where the window is fully open and a closed position where the window is partially restricted to produce pressure pulses in the drilling mud flowing through the rotor. The rotor is rotated either continuously in one direction (mud siren), incrementally by oscillating the rotor in one direction and then back to its original position, or incrementally in one direction only. Rotary pulsers are typically actuated by means of a torsional force applicator which rotates the rotor a short angular distance to either the open or closed position, with the rotor returning to its start position in each case. Motor speed changes are required to change the pressure pulse frequency.

Various parameters can affect the mud pulse signal strength and rate of attenuation such as original signal strength, carrier frequency, depth between surface transducer and downhole modulator, internal diameter of the drill pipe, density and viscosity of the drilling mud, volumetric flow rate of drilling mud, and flow area of the rotor window. Rotary valve pulsers require an axial gap between the stator and rotor to provide a flow area for drilling mud, even when the valve is in the "closed" position. As a result the rotary pulser is never completely closed as there must be some flow of drilling mud for satisfactory drilling operations to be conducted. The size of the gap is dictated by previously mentioned parameters. A skilled technician is required to set the correct gap size and to calibrate the pulser.

U.S. Pat. No. 8,251,160, issued Aug. 28, 2012, (incorporated herein by reference) discloses an example of a MP apparatus and method of using same. It highlights a number of examples of various types of MP generators, or "pulsers", which are familiar to those skilled in the art. U.S. Pat. No.

8,251,160 describes a rotor/stator design with windows in the rotor which align with windows in the stator. The stator also has a plurality of circular openings for flow of fluid therethrough. In a first orientation, the windows in the stator and the rotor align to create a fluid flow path orthogonal to the windows through the rotor and stator in addition to a fluid flow path through the circular openings in the stator. In this fashion the circulating fluid flows past and through the stator on its way to the drill bit without any significant obstruction to its flow. In the second orientation, the windows in the stator and the rotor do not align and there is restriction of fluid flow as the fluid only flows through the circular holes in the stator. This restriction creates a positive pressure pulse which is transmitted to the surface and decoded.

Another type of valve is a "poppet" or reciprocating pulser where the valve opens and closes against an orifice positioned axially against the drilling mud flow stream. Some have permanent magnets to keep the valve in an open position. The permanent magnet is opposed by a magnetizing coil powered by the MWD tool to release the poppet to close the valve.

Advantages of MP telemetry include increased depth capability, no dependence on earth formation, and current strong market acceptance. Disadvantages include many moving parts, difficulty with lost circulation material (LCM) usage, generally slower band rates, narrower bandwidth, and incompatibility with air/underbalanced drilling which is a growing market in North America. The latter is an issue as the signals are substantially degraded if the drilling fluid inside the drill pipe contains material quantities of gas. MP telemetry also suffers when there are low flow rates of drilling mud, as low mud flow rates may result in too low a pressure differential to produce a strong enough pulse signal at the surface. There are also a number of disadvantages of current MP generators, including limited speed of response and recovery, jamming due to accumulation of debris which reduces the range of motion of the valve, failure of the bellows seal around the servo-valve activating shaft, failure of the rotary shaft seal, failure of driveshaft components, flow erosion, fatigue, and difficulty accessing and replacing small parts.

SUMMARY

According to one aspect of the invention, there is provided a fluid pressure pulse generating apparatus comprising a pulser assembly and a fluid pressure pulse generator. The pulser assembly comprises a motor, a sensor for detecting rotation of the motor, a driveshaft rotationally coupled to the motor, and processing and motor control equipment communicative with the motor and the sensor. The fluid pressure pulse generator is coupled with the driveshaft.

The sensor may detect output signals generated by rotation of the motor. The motor may be a brushless motor and the sensor may be an inductive sensor. The inductive sensor may comprise a Hall Effect sensor or may comprise multiple Hall Effect sensors.

The pulser assembly may further comprise a gearbox coupled with the motor and the driveshaft. The motor may comprise a motor rotor rotationally mounted in a fixed motor stator. The motor rotor may comprise a first end having a rotatable output shaft and an opposed second end, whereby the output shaft is rotationally coupled to the driveshaft and the sensor is coupled with the second end.

The processing and motor control equipment may be electrically coupled with the motor and the sensor by at least one electrical interconnection extending therebetween. The pulser assembly may comprise a motor subassembly, an electronics subassembly, and a feed through connector located between the motor subassembly and the electronics subassembly. The motor subassembly may comprise a motor subassembly housing enclosing the motor, the sensor and the driveshaft. The electronics subassembly may comprise an electronics subassembly housing enclosing the processing and motor control equipment. The feed through connector may comprise a body with the at least one electrical interconnection extending axially through the body.

The pulser assembly may further comprise a mechanical stop sub-assembly comprising a collar fixedly coupled to the motor and at least one indexer protruding from a side of the driveshaft. The collar may comprise an angular movement restrictor window with a central window segment which axially and rotatably receives the driveshaft, and an indexing window segment in communication with the central window segment and which receives the indexer, the indexing window segment having an angular span across which the indexer can be oscillated by the driveshaft. The fluid pressure pulse generator may further comprise a stator, and a rotor fixedly attached to the driveshaft such that the angular span of the indexing window segment defines the angular range of the rotor's angular movement relative to the stator.

According to another aspect of the invention, there is provided a method for determining driveshaft position in a fluid pressure pulse generating apparatus comprising a pulser assembly comprising: a motor; a driveshaft rotationally coupled to the motor; a sensor for detecting rotation of the motor; and processing and motor control equipment communicative with the motor and the sensor; and a fluid pressure pulse generator coupled with the driveshaft. The method comprises: measuring output signals generated by rotation of the motor and detected by the sensor whereby a known number of output signals are generated per revolution of the motor; determining the amount of rotation of the driveshaft from the measured output signals based on the known number of output signals generated per revolution of the motor and a predetermined rotational relationship between the motor and the driveshaft, whereby each motor output signal represents a set amount of rotation of the driveshaft; and determining the driveshaft position from the amount of rotation of the driveshaft.

The motor may be a brushless motor and the output signals may comprise an alternating magnetic field. The sensor may comprise at least one Hall Effect sensor that varies its output voltage in response to the alternating magnetic field to generate a sensor state. The step of measuring output signals may comprise counting sensor states generated by rotation of the motor.

The pulser assembly may further comprise a gearbox coupled with the motor and the driveshaft, and the predetermined rotational relationship between the motor and the driveshaft may comprise a translation ratio of the gearbox whereby there is a set number of revolutions of the motor per revolution of the driveshaft. The translation ratio of the gearbox may be between 20:1 to 100:1 revolutions of the motor:driveshaft or any ratio therebetween.

The motor may be a four pole brushless motor and the sensor may comprise three Hall Effect sensors that generate twelve sensor states per revolution of the motor. The pulser assembly may further comprise a gearbox coupled with the motor and the driveshaft, and the predetermined rotational relationship between the motor and the driveshaft may comprise a gearbox translation ratio of 30:1 such that there are thirty revolutions of the motor per revolution of the driveshaft and each sensor state represents one degree rotation of the driveshaft.

According to another aspect of the invention, there is provided a method of controlling driveshaft rotation in a fluid pressure pulse generating apparatus comprising: a pulser assembly comprising: a motor; a driveshaft rotationally coupled to the motor; a sensor for detecting rotation of the motor; and processing and motor control equipment communicative with the motor and the sensor; and a fluid pressure pulse generator coupled with the driveshaft. The method comprises: rotating the motor to rotate the driveshaft from a first position to a second position; monitoring output signals generated by rotation of the motor and detected by the sensor whereby a known number of output signals are generated per revolution of the motor; determining when the driveshaft has reached the second position from the monitored output signals based on the known number of output signals generated per revolution of the motor and a predetermined rotational relationship between the motor and the driveshaft, whereby each motor output signal represents a set amount of rotation of the driveshaft; and stopping rotation of the motor when the driveshaft has reached the second position. The method may be used for calibrating the fluid pressure pulse generator, wherein the fluid pressure pulse generator is calibrated by moving the driveshaft to the second position.

The motor may be a brushless motor and the output signals may comprise an alternating magnetic field. The sensor may comprise at least one Hall Effect sensor that varies its output voltage in response to the alternating magnetic field to generate a sensor state. The step of measuring output signals may comprise counting sensor states generated by rotation of the motor.

The pulser assembly may further comprise a gearbox coupled with the motor and the driveshaft, and the predetermined rotational relationship between the motor and the driveshaft may comprise a translation ratio of the gearbox whereby there is a set number of revolutions of the motor per revolution of the driveshaft. The translation ratio of the gearbox may be between 20:1 to 100:1 revolutions of the motor:driveshaft or any ratio therebetween.

The motor may be a four pole brushless motor and the sensor may comprise three Hall Effect sensors that generate twelve sensor states per revolution of the motor. The pulser assembly may further comprise a gearbox coupled with the motor and the driveshaft, and the predetermined rotational relationship between the motor and the driveshaft may comprise a gearbox translation ratio of 30:1 such that there are thirty revolutions of the motor per revolution of the driveshaft and each sensor state represents one degree rotation of the driveshaft.

According to another aspect of the invention, there is provided a method of calibrating a fluid pressure pulse generator of a fluid pulse generating apparatus comprising: a pulser assembly comprising: a motor; a driveshaft rotationally coupled to the motor; a sensor for detecting rotation of the motor; processing and motor control equipment communicative with the motor and the sensor; and a mechanical stop sub-assembly comprising: a collar fixedly coupled to the motor and at least one indexer protruding from a side of the driveshaft, the collar comprising an angular movement restrictor window with a central window segment which axially and rotatably receives the driveshaft, and an indexing window segment in communication with the central window segment and which receives the indexer, the indexing window segment having an angular span across which the indexer can be oscillated by the driveshaft; and the fluid pressure pulse generator comprising a stator, and a rotor fixedly attached to the driveshaft such that the angular span of the indexing window segment defines the angular range of the rotor's angular movement relative to the stator. The method comprises: rotating the motor to rotate the driveshaft and oscillate the indexer across the angular span of the indexing window segment; measuring output signals generated by rotation of the motor and detected by the sensor as the indexer oscillates across the angular span, whereby a known number of output signals are generated per revolution of the motor; determining the number of output signals detected per oscillation of the indexer across the angular span; calculating the number of output signals that need to be generated by rotation of the motor to rotate the driveshaft from a first position where the indexer is at an edge of the indexing window segment to a calibration position within the angular span from the number of motor output signals detected per oscillation of the indexer across the angular span; rotating the motor to rotate the driveshaft from the first position to the calibration position and counting output signals generated by rotation of the motor and detected by the sensor during rotation of the driveshaft from the first position to the calibration position; and stopping rotation of the motor when the number of output signals counted equals the calculated number of output signals.

The calibration position may be the central point of the angular span of the indexing window segment whereby the rotor is positioned relative to the stator to flow a drilling fluid in a full flow configuration to produce no pressure pulse.

The motor may be a brushless motor and the output signals may comprise an alternating magnetic field. The sensor may comprise at least one Hall Effect sensor that varies its output voltage in response to the alternating magnetic field to generate a sensor state, and the step of measuring output signals and the step of counting output signals may comprise counting sensor states generated by rotation of the motor.

According to another aspect of the invention, there is provided a method of controlling timing of pressure pulses in a fluid pressure pulse generating apparatus comprising: a pulser assembly comprising: a motor; a driveshaft rotationally coupled to the motor; a sensor for detecting rotation of the motor; and processing and motor control equipment communicative with the motor and the sensor; and a fluid pressure pulse generator comprising a stator, and a rotor rotationally coupled to the driveshaft whereby rotation of the driveshaft rotates the rotor to flow a drilling fluid in a full flow configuration to produce no pressure pulse and a reduced flow configuration to produce a pressure pulse. The method comprises: rotating the motor to rotate the driveshaft to transition the rotor from the full flow configuration to the reduced flow configuration and from the reduced flow configuration to the full flow configuration to generate pressure pulses; monitoring output signals generated by rotation of the motor and detected by the sensor whereby a known number of output signals are generated per revolution of the motor; determining the amount of rotation of the driveshaft from the measured output signals based on the known number of output signals generated per revolution of the motor and a predetermined rotational relationship between the motor and the driveshaft, whereby each motor output signal represents a set amount of rotation of the driveshaft; determining the rotor position from the amount of rotation of the driveshaft based on a predetermined rotational relationship between the driveshaft and the rotor; determining completion of transition of the rotor from the full flow configuration to the reduced flow configuration or from the reduced flow configuration to the full flow configuration from the determined rotor position; and controlling timing of the generated pressure pulses based on the determined completion of transition of the rotor, whereby the next rotor transition is controlled to occur after the previous rotor transition is complete. The start of the next rotor transition may be controlled to begin sooner or later than the scheduled start of the next rotor transition The reduced flow configuration may produce a first pressure pulse and the rotor may be further rotatable by the driveshaft to flow the drilling fluid in an intermediate flow configuration to produce a second pressure pulse, the first pressure pulse having a greater amplitude than the second pressure pulse. In the step of rotating the motor the rotor may be transitioned between the full flow configuration and the reduced flow configuration to produce the first pressure pulse and between the full flow configuration and the intermediate flow configuration to produce the second pressure pulse. The step of determining completion of transition may further comprise determining completion of transition of the rotor from the full flow configuration to the intermediate flow configuration or from the intermediate flow configuration to the full flow configuration from the determined rotor position.

The motor may be a brushless motor and the output signals may comprise an alternating magnetic field. The sensor may comprise at least one Hall Effect sensor that varies its output voltage in response to the alternating magnetic field to generate a sensor state. The step of measuring output signals may comprise counting sensor states generated by rotation of the motor.

The pulser assembly may further comprise a gearbox coupled with the motor and the driveshaft, and the predetermined rotational relationship between the motor and the driveshaft may comprise a translation ratio of the gearbox whereby there is a set number of revolutions of the motor per revolution of the driveshaft. The translation ratio of the gearbox may be between 20:1 to 100:1 revolutions of the motor:driveshaft or any ratio therebetween.

The motor may be a four pole brushless motor and the sensor may comprise three Hall Effect sensors that generate twelve sensor states per revolution of the motor. The pulser assembly may further comprise a gearbox coupled with the motor and the driveshaft, and the predetermined rotational relationship between the motor and the driveshaft may comprise a gearbox translation ratio of 30:1 such that there are thirty revolutions of the motor per revolution of the driveshaft and each sensor state represents one degree rotation of the driveshaft.

The rotor may be fixed to the driveshaft and the predetermined rotation relationship between the driveshaft and the rotor may be 1:1 such that rotation of the driveshaft results in an equivalent amount of rotation of the rotor.

The method may further comprise measuring electrical input into the motor required to rotate the motor to generate the pressure pulses, processing the measured electrical input information to provide an indication of motor torque and duration of applied power, and controlling timing of the generated pressure pulses based on the processed electrical input information. The electrical input into the motor may be a measurement of electric power, voltage and current provided by a motor driver to the motor.

The method may further comprise measuring pressure of the pressure pulses generated, processing the pressure measurement data to determine the shape of the pressure pulses and the latency of transition of the generated pressure pulses in the drilling fluid, and controlling timing of the generated pressure pulses based on the processed pressure measurement data. The pressure may be measured using a pressure transducer. The pressure transducer may be positioned in a feed-through connector positioned between the motor and the processing and motor control equipment, the feed-through connector providing electrical communication between the motor and the processing and motor control equipment.

DETAILED DESCRIPTION

The embodiments described herein generally relate to a fluid pressure pulse generating apparatus and a method of using same. The fluid pressure pulse generating apparatus of the embodiments described herein may be used for mud pulse (MP) telemetry used in downhole drilling. The fluid pressure pulse generating apparatus may alternatively be used in other methods to generate a fluid pressure pulse.

Apparatus Overview

Figure 1:
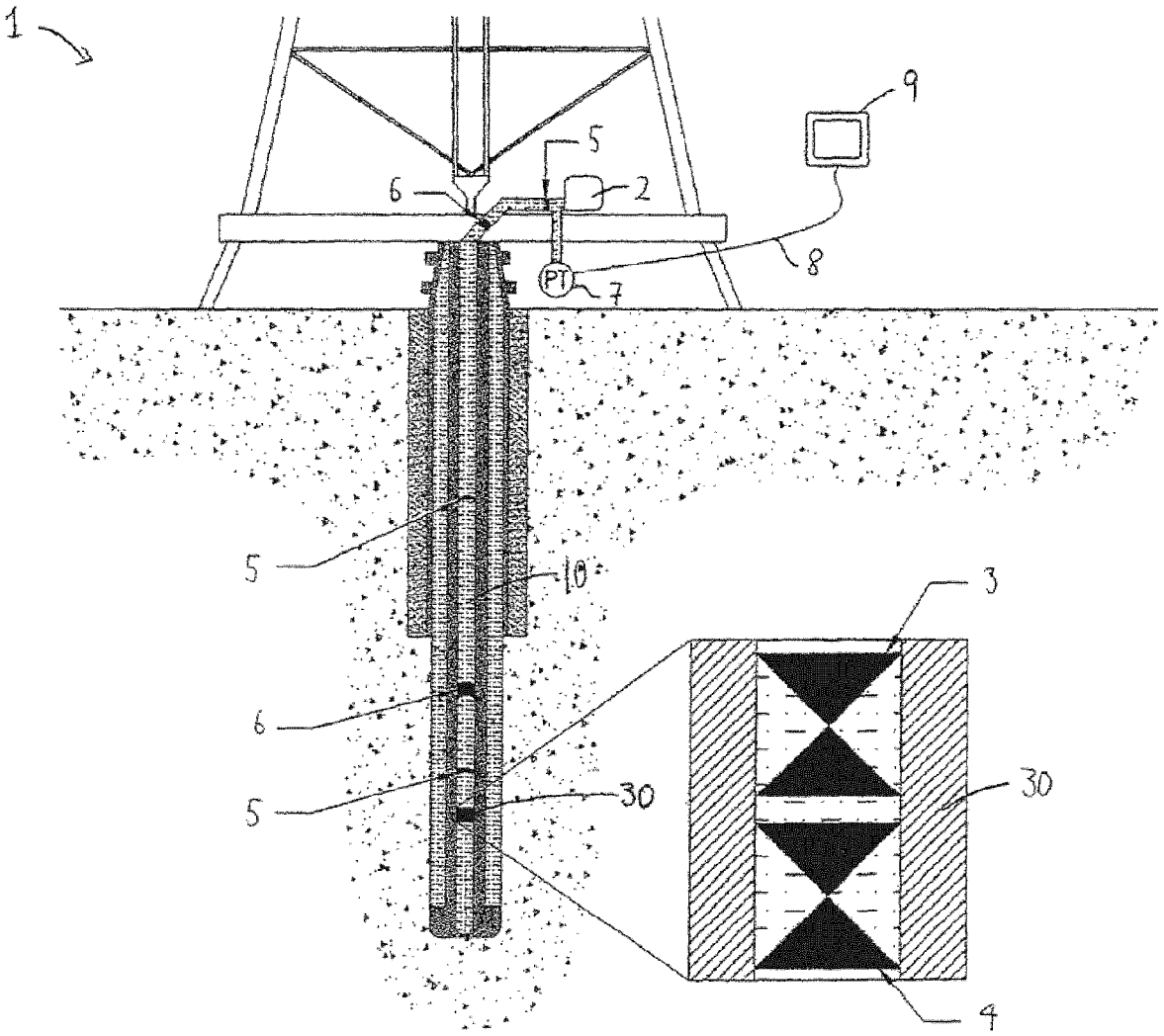
FIG. 1 is a schematic of a mud pulse (MP) telemetry method used in downhole drilling.

Referring to the drawings and specifically to FIG. 1, there is shown a schematic representation of a MP telemetry method using the fluid pressure pulse generating apparatus of the described embodiments. In downhole drilling equipment 1, drilling fluid or "mud" is pumped down a drill string by pump 2 and passes through a measurement while drilling (MWD) tool 20. The MWD tool 20 includes a fluid pressure pulse generator 30 with a reduced flow configuration (schematically represented as valve 3) which generates a full positive pressure pulse (represented schematically as full pressure pulse 6) and an intermediate flow configuration (schematically represented as valve 4) which generates an intermediate positive pressure pulse (represented schematically as intermediate pressure pulse 5). Intermediate pressure pulse 5 is reduced compared to the full pressure pulse 6. Information acquired by downhole sensors (not shown) is transmitted in specific time divisions by the pressure pulses 5, 6 in mud column 10. More specifically, signals from sensor modules in the MWD tool 20 or in another probe are received and processed in a data encoder in the MWD tool 20 where the data is digitally encoded as is well established in the art. This data is sent to a controller in the MWD tool 20 which then actuates the fluid pressure pulse generator 30 to generate pressure pulses 5, 6 which contain the encoded data. The pressure pulses 5, 6 are transmitted to the surface and detected by a surface pressure transducer 7. The measured pressure pulses are transmitted as electrical signals through transducer cable 8 to a surface computer 9 which decodes and displays the transmitted information to the drilling operator.

The characteristics of the pressure pulses 5, 6 are defined by amplitude, duration, shape, and frequency, and these characteristics are used in various encoding systems to represent binary data. The ability to produce two different sized pressure pulses 5, 6, allows for greater variation in the binary data being produced and therefore quicker and more accurate interpretation of downhole measurements.

One or more signal processing techniques are used to separate undesired mud pump noise, rig noise or other noise effects from the generated MWD signals as is known in the art. The data transmission rate is governed by Lamb's theory for acoustic waves in a drilling mud and is approximately 1.1 to 1.5 km/s. The fluid pressure pulse generator 30 operates in an unfriendly environment including high static downhole pressures, high temperatures, high flow rates and various erosive flow types. The fluid pressure pulse generator 30 generates pulses between 100 and 300 psi and operates in a flow rate dictated by the size of the drill pipe bore and limited by surface pumps, drill bit total flow area (TFA), and mud motor/turbine differential requirements for drill bit rotation.

Figure 2:
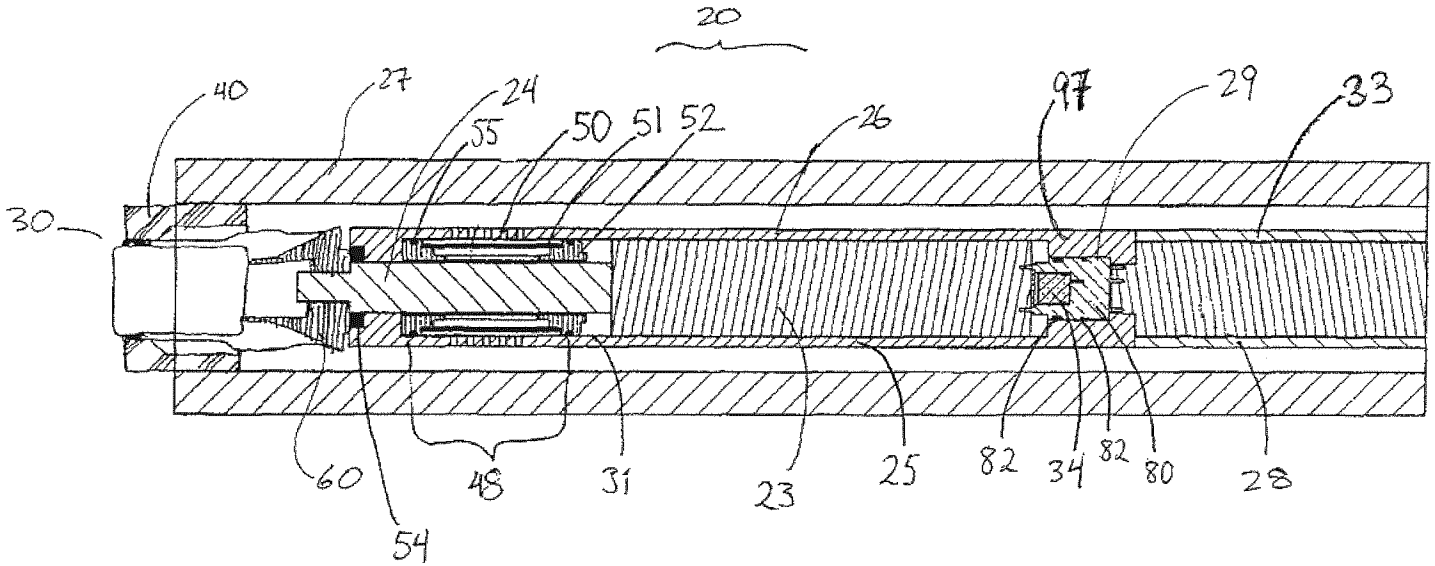
FIG. 2 is a longitudinally sectioned view of a mud pulser section of a MWD tool comprising a pulser assembly and fluid pressure pulse generator in accordance with an embodiment.
Figure 3:
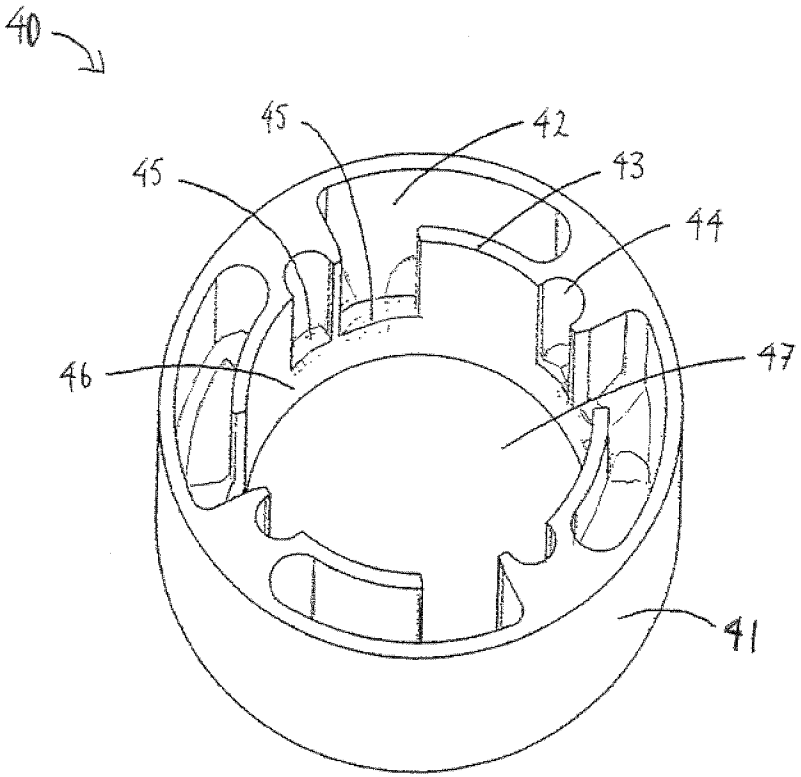
FIG. 3 is a perspective view of a stator of the fluid pressure pulse generator.
Figure 4:
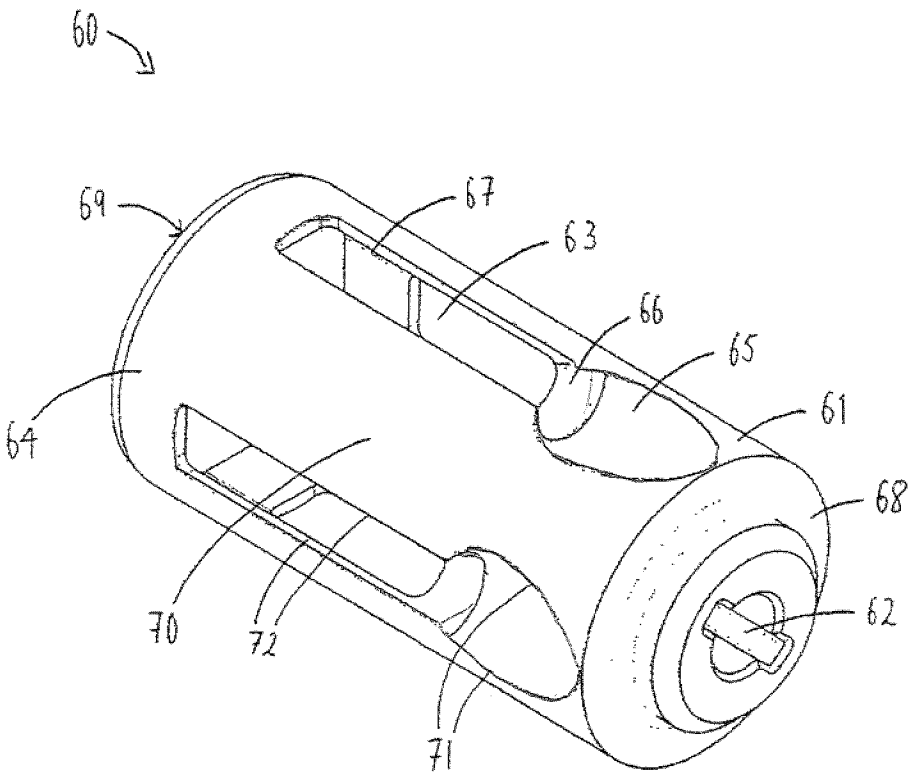
FIG. 4 is a perspective view of a rotor of the fluid pressure pulse generator.

Referring now to FIG. 2, the mud pulser section of the MWD tool 20 is shown in more detail. The mud pulser section of the MWD tool 20 generally comprises the fluid pressure pulse generator 30 which creates fluid pressure pulses and a pulser assembly 26 which takes measurements while drilling and which drives the fluid pressure pulse generator 30. The fluid pressure pulse generator 30 and pulser assembly 26 are axially located inside a landing sub 27 with an annular gap therebetween to allow drilling mud to flow through the gap. The fluid pressure pulse generator 30 generally comprises a stator 40 and a rotor 60. The stator 40 is fixed to the landing sub 27 and the rotor 60 is fixed to a driveshaft 24 of the pulser assembly 26. The pulser assembly 26 includes a motor subassembly 25 and an electronics subassembly 28.

The motor subassembly 25 comprises a motor subassembly housing 31 enclosing a motor and gearbox subassembly 23, driveshaft 24 and a pressure compensation device 48 surrounding a portion of the driveshaft 24. The electronics subassembly 28 includes an electronics subassembly housing 33 which has a low pressure (approximately atmospheric) internal environment for control electronics and other components (not shown) used by the MWD tool 20 to receive direction and inclination information and measurements of drilling conditions and encode this information and these measurements into telemetry data for transmission by the fluid pressure pulse generator 30 as is known in the art. This telemetry data is converted into motor control signals which are sent to the motor and gearbox subassembly 23 to rotate the driveshaft 24 and rotor 60 in a controlled pattern to generate pressure pulses 5, 6 representing the telemetry data.

The motor subassembly 25 is filled with a lubrication liquid such as hydraulic oil or silicon oil. The lubrication liquid is fluidly separated from drilling mud flowing external to the pulser assembly 26 by seal 54. The pressure compensation device 48 substantially equalizes the pressure of lubrication liquid inside the motor subassembly 25 with the pressure of external drilling mud. Without pressure compensation, the torque required to rotate the driveshaft 24 would need high current draw with excessive battery consumption and increased costs. The seal 54 may be a standard polymer lip seal provided at the downhole end of driveshaft 24 and enclosed by the motor subassembly housing 31. The seal 54 allows rotation of the driveshaft 24 and prevents mud from entering the motor subassembly housing 31 and lubrication liquid from leaking out of the motor subassembly housing 31, thereby maintaining the pressure of the lubrication liquid inside the motor subassembly housing 31.

The pressure compensation device 48 is a generally tubular device that extends around a portion of the driveshaft 24 and is enclosed by the motor subassembly housing 31. The pressure compensation device 48 comprises a generally cylindrical flexible membrane 51 and a membrane support 52 for supporting the membrane 51. The membrane support 52 comprises a generally cylindrical structure with a central bore that allows the driveshaft 24 to extend therethrough. The membrane support 52 has two end sections with an outer diameter that abuts against the inside surface of the motor subassembly housing 31. O-ring seals 55 provide a fluid seal between the motor subassembly housing 31 and the end sections. The end sections have a membrane mount for mounting respective ends of the membrane 51.

The motor subassembly housing 31 includes a plurality of apertures or ports 50 extending radially through the housing wall. The ports 50 allow drilling mud to come into contact with membrane 51. The membrane 51 provides a fluid barrier between the drilling mud on one side and the lubrication liquid on the other side. As is known in the art, the membrane 51 can flex to compensate for pressure changes in the drilling mud and allows the pressure of the internal lubrication liquid to substantially equalize with the pressure of the external drilling mud. In alternative embodiments (not shown), the pressure compensation device need not be a flexible polymer membrane device and may be any pressure compensation device known in the art, such as pressure compensation devices that utilize pistons, metal membranes, or a bellows style pressure compensation mechanism.

The motor subassembly 25 and the electronics subassembly 28 are physically and electronically coupled together by a feed-through connector 29. Feed through connector 29 is a typical connector known in the art and is pressure rated to withstand the pressure differential between the low-pressure electronics subassembly 28 (approximately atmospheric pressure) and the pressure compensated motor subassembly 25 where pressures can reach approximately 20,000 psi. The feed-through connector 29 comprises a body 80 having a generally cylindrical shape with a high pressure end facing the motor subassembly 25 and a low pressure end facing the electronics subassembly 28. A pressure transducer 34 is seated inside the feed through connector 29 (collectively "pressure transducer and feed through subassembly 29, 34") and faces the inside of the motor subassembly 25. The pressure transducer 34 can thus measure the pressure of the lubrication liquid inside the motor subassembly 25. Because the pressure of the lubrication liquid substantially corresponds to the pressure of the external drilling mud at the fluid pressure pulse generator 30 as a result of the pressure compensation device 48, the pressure transducer 34 can be used to measure the pressure of pressure pulses 5, 6 generated by the fluid pressure pulse generator 30. As will be discussed below in more detail, these measurements can be used to provide useful data for controlling pulse generation and operating the fluid pressure pulse generator 30 in an optimized and effective manner. The uphole end of the motor subassembly housing 31 is provided with an annular shoulder 97 in which the pressure transducer and feed through subassembly 29, 34 is seated. O-ring seals 82 provide a fluid seal between the feed-through connector body 80 and the motor subassembly housing annular shoulder 97. Electrical interconnections extend axially through the length of the body 80 of the feed through connector 29 which transmit power and control signals between components in the electronics subassembly 28 and the motor and gearbox subassembly 23. In alternative embodiments, a pressure transducer configured to measure pressure pulses may be provided in a separate remotely located pressure probe connected to electronics of the MWD tool 20 by a conventional wire harness or the like.

Fluid Pressure Pulse Generator

Figure 5:
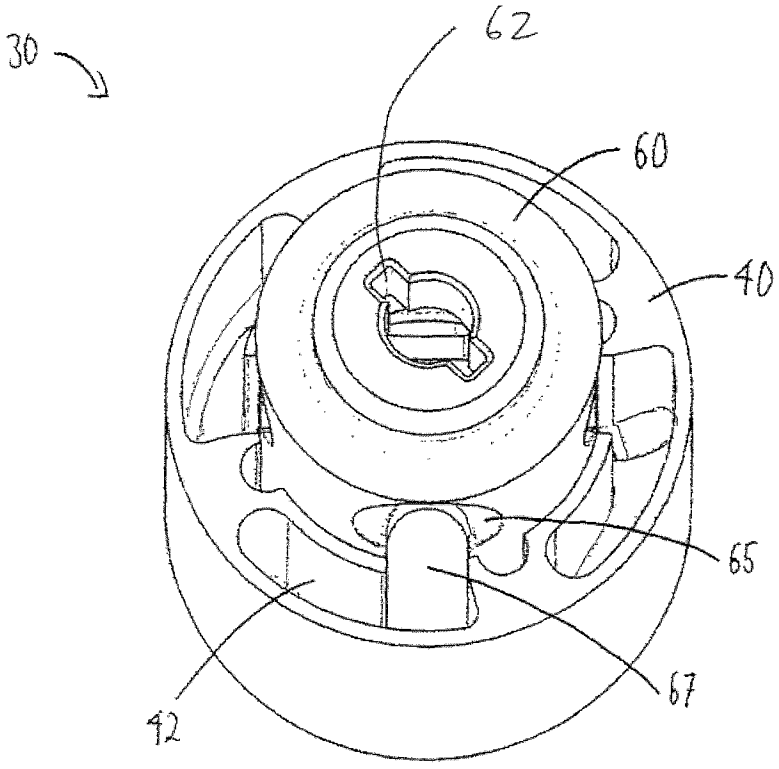
FIG. 5 is a perspective view of the rotor/stator combination of the fluid pressure pulse generator in full flow configuration.
Figure 6:
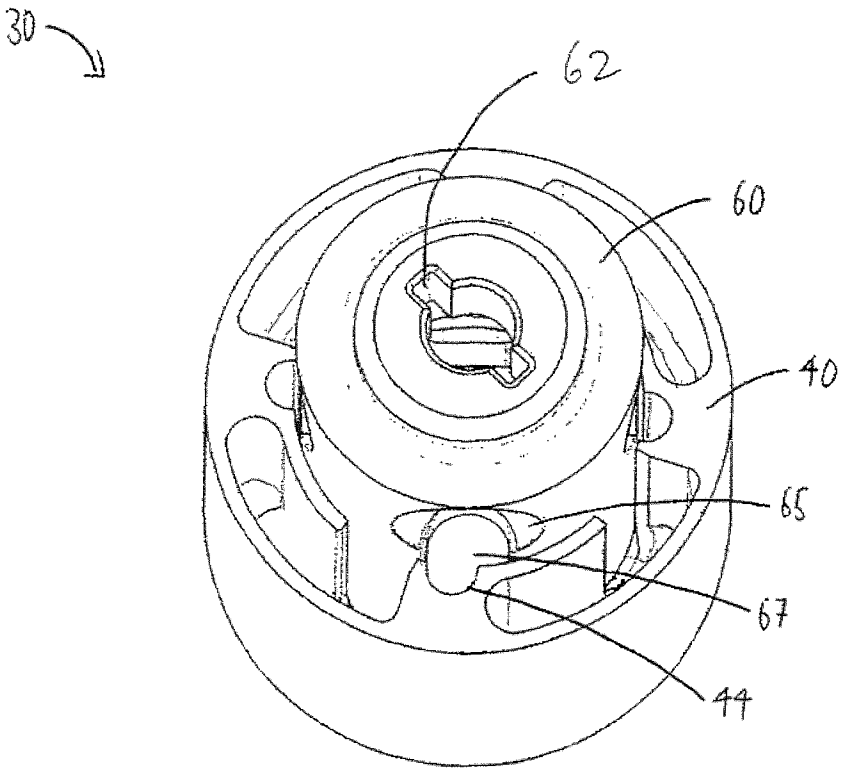
FIG. 6 is a perspective view of the rotor/stator combination of FIG. 5 in intermediate flow configuration.
Figure 7:
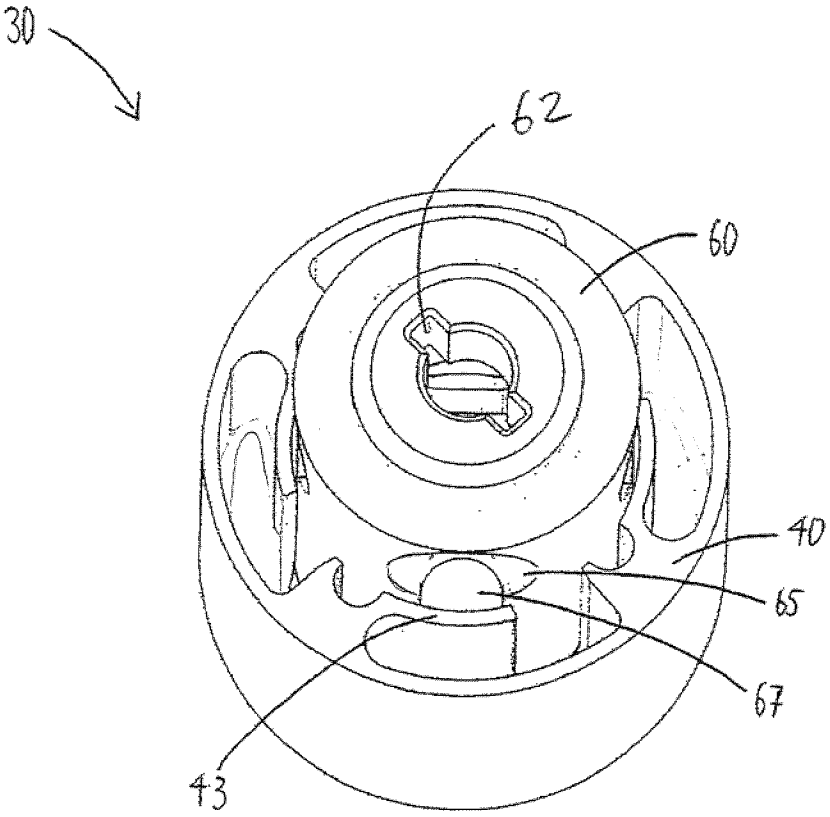
FIG. 7 is a perspective view of the rotor/stator combination of FIG. 5 in reduced flow configuration.

Referring now to FIGS. 3 to 7, there is shown the stator 40 and rotor 60 which combine to form the fluid pressure pulse generator 30. The rotor 60 comprises a circular body 61 having an uphole end 68 with a driveshaft receptacle 62 and a downhole opening 69. The driveshaft receptacle 62 is configured to receive and fixedly connect with the driveshaft 24 of the pulser assembly 26, such that in use the rotor 60 is rotated by the driveshaft 24. The stator 40 comprises a stator body 41 with a circular opening 47 therethrough sized to receive the circular body 61 of the rotor as shown in FIGS. 5 to 7. The stator body 41 may be annular or ring shaped as shown in the embodiment of FIGS. 3 to 7, to enable it to fit within a drill collar of a downhole drill string. In alternative embodiments (not shown) the stator body may be a different shape, for example square shaped, rectangular shaped, or oval shaped depending on the fluid pressure pulse operation it is being used for.

The stator 40 and rotor 60 are made up of minimal parts and their configuration beneficially provides easy alignment and fitting of the rotor 60 within the stator 40. There is no positioning or height requirement and no need for an axial gap between the stator 40 and the rotor 60 as is required with known rotating disc valve pulsers. It is therefore not necessary for a skilled technician to be involved with set up of the fluid pressure pulse generator 30 and the operator can easily change or service the stator/rotor combination 40, 60 if flow rate conditions change or there is damage to the rotor 60 or stator 40 during operation.

The circular body 61 of the rotor has fluid openings 67 separated by leg sections 70 and a mud lubricated journal bearing ring section 64 defining the downhole opening 69. The bearing ring section 64 helps centralize the rotor 60 in the stator 40 and provides structural strength to the leg sections 70. The circular body 61 also includes surface depressions 65 that are shaped like the head of a spoon on an external surface of the circular body 61. Each spoon shaped depression 65 is connected to one of the fluid openings 67 by a flow channel 66 on the external surface of the body 61. Each connected spoon shaped depression 65, flow channel 66 and fluid opening 67 forms a fluid diverter and there are four fluid diverters positioned equidistant circumferentially around the circular body 61. In alternative embodiments (not shown), there may be more or less fluid diverters positioned around the circular body 61.

Fluid flowing in a downhole direction external to the circular body 61 is directed through the fluid openings 67 into a hollow internal area 63 of the body and out of the downhole opening 69. The spoon shaped depressions 65 gently slope, with the depth of the depression increasing from the uphole end to the downhole end of the depression ensuring that the axial flow path or radial diversion of the fluid is gradual without sharp turns. This is in contrast to the stator/rotor combination described in U.S. Pat. No. 8,251,160, where windows in the stator and the rotor align to create a fluid flow path orthogonal to the windows through the rotor and stator. The depth of the spoon shaped depressions 65 can vary depending on flow parameter requirements.

The spoon shaped depressions 65 act as a nozzle to aid fluid flow. Without being bound by science, it is thought that the nozzle design results in increased volume of fluid flowing through the fluid opening 67 compared to an equivalent fluid diverter without the nozzle design, such as the window fluid opening of the rotor/stator combination described in U.S. Pat. No. 8,251,160. Curved edges 71 of the spoon shaped depressions 65 also provide less resistance to fluid flow and reduction of pressure losses across the rotor/stator as a result of optimal fluid geometry. Furthermore, the curved edges 71 of the spoon shaped depressions 65 have a reduced surface compared to, for example, a channel having the same flow area as the spoon shaped depression 65. This means that the surface area of the curved edges 71 cutting through the drilling mud when the rotor is rotated is minimized, thereby reducing the force required to rotate the rotor and reducing the motor torque requirement. By reducing the motor torque requirement, there is beneficially a reduction in battery consumption and less wear on the motor, which may beneficially reduce costs.

Motor torque requirement is also reduced by minimizing the surface area of edges 72 of each leg section 70 which are perpendicular to the direction of rotation. Edges 72 cut through the drilling mud during rotation of the rotor 60 and therefore beneficially have as small a surface area as possible while still maintaining structural stability of the leg sections 70. To increase structural stability of the leg sections 70, the thickness at the middle part of the leg section 70 furthest from the edges 72 may be greater than the thickness at the edges 72, although the wall thickness of each leg section 70 may be consistent. In addition, the bearing ring section 64 of the circular body 61 provides structural stability to the leg sections 70.

In alternative embodiments (not shown) a different curved shaped depression other than the spoon shaped depression may be utilized on the external surface of the rotor, such as egg shaped, oval shaped, arc shaped, or circular shaped. Furthermore, the flow channel 66 may not be present and the fluid openings 67 may be any shape or size.

The stator body 41 includes full flow chambers 42, intermediate flow chambers 44 and walled sections 43 in alternating arrangement around the stator body 41. In the embodiment shown in FIGS. 3 to 7, the full flow chambers 42 are L shaped and the intermediate flow chambers 44 are U shaped. In alternative embodiments (not shown) other configurations may be used for the flow chambers 42, 44. The geometry of the flow chambers is not critical provided the flow area of the full flow chambers 42 is greater than the flow area of the intermediate flow chambers 44. A solid bearing ring section 46 at the downhole end of the stator body 41 helps centralize the rotor in the stator and reduces flow of fluid between the external surface of the rotor 60 and the internal surface of the stator 40. Four flow sections are positioned equidistant around the circumference of the stator 40, with each flow section having one of the intermediate flow chambers 44, one of the full flow chambers 42, and one of the walled sections 43. The full flow chamber 42 of each flow section is positioned between the intermediate flow chamber 44 and the walled section 43. In alternative embodiments (not shown) there may be more or less flow sections and a different arrangement of the full flow chamber 42, intermediate flow chamber 44 and walled section 43 in each flow section.

In use, each of the flow sections of the stator 40 interacts with one of the fluid diverters of the rotor 60. The rotor 60 is rotated relative to the fixed stator 40 to provide three different flow configurations as follows:

1. Full flow—where the rotor fluid openings 67 align with the stator full flow chambers 42, as shown in FIG. 5;
2. Intermediate flow—where the rotor fluid openings 67 align with the stator intermediate flow chambers 44, as shown in FIG. 6; and
3. Reduced flow—where the rotor fluid openings 67 align with the stator walled sections 43, as shown in FIG. 7.

In the full flow configuration shown in FIG. 5, the stator full flow chambers 42 align with the fluid openings 67 and flow channels 66 of the rotor, so that drilling mud flows from the full flow chambers 42 through the fluid openings 67. The flow area of the full flow chambers 42 may correspond to the flow area of the rotor fluid openings 67. This corresponding sizing beneficially leads to no or minimal resistance in flow of drilling mud through the fluid openings 67 when the rotor is positioned in the full flow configuration. There is zero pressure increase and no pressure pulse is generated in the full flow configuration. The L shaped configuration of the full flow chambers 42 minimizes space as each L shaped full flow chamber 42 tucks behind one of the walled sections 43 allowing for a compact stator design, which may beneficially reduce production costs and result in less likelihood of blockage.

When the rotor 60 is positioned in the reduced flow configuration as shown in FIG. 7, there is no flow area in the stator as the stator walled sections 43 align with the fluid openings 67 and flow channels 66 of the rotor. Drilling mud is still diverted by the spoon shaped depressions 65 along the flow channels 66 and through the fluid openings 67, however, the total overall flow area is reduced compared to the total overall flow area in the full flow configuration. The fluid pressure therefore increases to generate the full pressure pulse 6.

In the intermediate flow configuration as shown in FIG. 6, the stator intermediate flow chambers 44 align with the fluid openings 67 and flow channels 66 of the rotor, so that drilling mud flows from the intermediate flow chambers 44 through the fluid openings 67. The flow area of the intermediate flow chambers 44 is less than the flow area of the full flow chambers 42, therefore, the total overall flow area in the intermediate flow configuration is less than the total overall flow area in the full flow configuration, but more than the total overall flow area in the reduced flow configuration. As a result, the flow of drilling mud through the fluid openings 67 in the intermediate flow configuration is less than the flow of drilling mud through the fluid openings 67 in the full flow configuration, but more than the flow of drilling mud through the fluid openings 67 in the reduced flow configuration. The intermediate pressure pulse 5 is generated which is reduced compared to the full pressure pulse 6. The flow area of the intermediate flow chambers 44 may be one half, one third, one quarter the flow area of the full flow chambers 42, or any amount that is less than the flow area of the full flow chambers 42 to generate the intermediate pressure pulse 5 and allow for differentiation between intermediate pressure pulse 5 and full pressure pulse 6.

When the rotor 60 is positioned in the reduced flow configuration as shown in FIG. 7, drilling mud is still diverted by the spoon shaped depressions 65 along the flow channels 66 and through the fluid openings 67 otherwise the pressure build up would be detrimental to operation of downhole drilling. In contrast to the rotor/stator combination disclosed in U.S. Pat. No. 8,251,160, where the constant flow of drilling mud is through a plurality of circular holes in the stator, in the present embodiment, the constant flow of drilling mud is through the rotor fluid openings 67. This may beneficially reduce the likelihood of blockages and also allows for a more compact stator design as there is no need to have additional fluid openings in the stator.

A bottom face surface 45 of both the full flow chambers 42 and the intermediate flow chambers 44 of the stator 40 may be angled in the downhole flow direction for smooth flow of drilling mud from chambers 42, 44 through the rotor fluid openings 67 in the full flow and intermediate flow configurations respectively, thereby reducing flow turbulence. In all three flow configurations the full flow chambers 42 and the intermediate flow chambers 44 are filled with drilling mud, however flow from the flow chambers 42, 44 will be restricted unless the rotor fluid openings 67 are aligned with the full flow chambers 42 or intermediate flow chambers 44 in the full flow and intermediate flow configurations respectively.

A combination of the spoon shaped depressions 65 and flow channels 66 of the rotor 60 and the angled bottom face surface 45 of the flow chambers 42, 44 of the stator provide a smooth fluid flow path with no sharp angles or bends. The smooth fluid flow path may beneficially reduce abrasion and wear on the pulser assembly 26.

Provision of the intermediate flow configuration allows the operator to choose whether to use the reduced flow configuration, intermediate flow configuration or both configurations to generate pressure pulses depending on drilling mud flow conditions. For higher fluid flow rate conditions, the pressure generated using the reduced flow configuration may be too great and cause damage to the apparatus. The operator may therefore choose to use only the intermediate flow configuration to produce detectable pressure pulses at the surface. For lower fluid flow rate conditions, the pressure pulse generated in the intermediate flow configuration may be too low to be detectable at the surface. The operator may therefore choose to operate using only the reduced flow configuration to produce detectable pressure pulses at the surface. Thus it is possible for the downhole drilling operation to continue when the fluid flow conditions change without having to change the fluid pressure pulse generator 30. For normal fluid flow conditions, the operator may choose to use both the reduced flow configuration and the intermediate flow configuration to produce two distinguishable pressure pulses 5, 6 at the surface and increase the data rate of the fluid pressure pulse generator 30. If one of the stator flow chambers (either full flow chambers 42 or intermediate flow chambers 44) is blocked or damaged, or one of the stator walled sections 43 is damaged, operations can continue, albeit at reduced efficiency, until a convenient time for maintenance. For example, if one or more of the stator walled sections 43 is damaged, the full pressure pulse 6 will be affected; however operation may continue using the intermediate flow configuration to generate intermediate pressure pulse 5. Alternatively, if one or more of the intermediate flow chambers 44 is damaged or blocked, the intermediate pulse 5 will be affected; however operation may continue using the reduced flow configuration to generate the full pressure pulse 6. If one or more of the full flow chambers 42 is damaged or blocked, operation may continue by rotating the rotor between the reduced flow configuration and the intermediate flow configuration. Although there will be no zero pressure state, there will still be a pressure differential between the full pressure pulse 6 and the intermediate pressure pulse 5 which can be detected and decoded at surface until the stator 40 can be serviced. Furthermore, if one or more of the rotor fluid openings 67 is damaged or blocked which results in one of the flow configurations not being usable, the other two flow configurations can be used to produce a detectable pressure differential. For example, damage to one of the rotor fluid openings 67 may result in an increase in drilling mud flow through the rotor 60 such that the intermediate flow configuration and the full flow configuration do not produce a detectable pressure differential, and the reduced flow configuration will need to be used to get a detectable pressure pulse.

Provision of multiple rotor fluid openings 67 and multiple stator flow chambers 42, 44 and walled sections 43, provides redundancy and allows the fluid pressure pulse generator 30 to continue working when there is damage or blockage to one of the rotor fluid openings 67 and/or one of the stator chambers 42, 44 or walled sections 43. Cumulative flow of drilling mud through the remaining undamaged or unblocked rotor fluid openings 67 and stator flow chambers 42, 44 still results in generation of detectable full or intermediate pressure pulses 5, 6, even though the pulse heights may not be the same as when there is no damage or blockage.

It is evident from the foregoing that while the embodiments shown in FIGS. 3 to 7 utilize four fluid openings 67 together with four full flow chambers 42, four intermediate flow chambers 44 and four walled sections 43 in the stator, different numbers of rotor fluid openings 67, stator flow chambers 42, 44 and stator walled sections 43 may be used. Provision of more rotor fluid openings 67, stator flow chambers 42, 44 and stator walled section 43 beneficially reduces the amount of rotor rotation required to move between the different flow configurations, however, too many rotor fluid openings 67, stator flow chambers 42, 44 and stator walled sections 43 may decrease the stability of the rotor 60 and/or stator 40 and may result in a less compact design thereby increasing production costs. Furthermore, the number of rotor fluid openings 67 need not match the number of stator flow chambers 42, 44 and stator walled sections 43. Different combinations may be utilized according to specific operation requirements of the fluid pressure pulse generator 30. In alternative embodiments (not shown), the intermediate flow chambers 44 need not be present or there may be additional intermediate flow chambers 44 present that have a flow area less than the flow area of full flow chambers 42. The flow area of the additional intermediate flow chambers may vary to produce additional intermediate pressure pulses and increase the data rate of the fluid pressure pulse generator 30. The innovative aspects of the invention apply equally in embodiments such as these.

It is also evident from the foregoing that while the embodiments shown in FIGS. 3 to 7 utilize fluid openings in the rotor and flow chambers in the stator, in alternative embodiments (not shown) the fluid openings may be positioned in the stator and the flow chambers may be present in the rotor. In these alternative embodiments the rotor still rotates between full flow, intermediate flow and reduced flow configurations whereby the fluid openings in the stator align with full flow chambers, intermediate flow chambers and walled sections of the rotor respectively. The innovative aspects of the invention apply equally in embodiments such as these.

Staged Oscillation Method

In use of the fluid pressure pulse generator shown in FIGS. 5-7, the rotor 60 oscillates back and forth between the full flow, intermediate flow and reduced flow configurations in a staged oscillation method to generate a pattern of pressure pulses. The rotor 60 starts in the full flow configuration as shown in FIG. 5 with the rotor fluid openings 67 aligned with the stator full flow chambers 42 so there is zero pressure. The rotor 60 then rotates to either one of two different positions depending on the pressure pulse pattern desired as follows:

Position 1—rotation 30 degrees in an anticlockwise direction to the intermediate flow configuration as shown in FIG. 6 where the rotor fluid openings 67 align with the stator intermediate flow chambers 44 to generate the intermediate pressure pulse 5; or Position 2—rotation 30 degrees in a clockwise direction to the reduced flow configuration as shown in FIG. 7 where the rotor fluid openings 67 align with the stator walled sections 43 to generate the full pressure pulse 6.

After generation of either the intermediate pressure pulse 5 or the full pressure pulse 6, the rotor returns to the start position (i.e. the full flow configuration with zero pressure) before generating the next pressure pulse. For example, the rotor can rotate in the following pattern:

start position-position 1-start position-position 1-start position-position 2-start position This will generate:

intermediate pressure pulse 5-intermediate pressure pulse 5-full pressure pulse 6.

Return of the rotor 60 to the start position between generation of each pressure pulse allows for a constant reset of timing and position for signal processing and precise control. The start position at zero pressure provides a clear indication of the end of a previous pulse and start of a new pulse. Also if the rotor 60 is impacted during operation or otherwise moves out of position, the rotor 60 can return to the start position to recalibrate and start over. This may beneficially reduce the potential for error over the long term performance of the fluid pressure pulse generator 30.

A precise pattern of pressure pulses can therefore be generated through rotation of the rotor 30 degrees in a clockwise direction and 30 degrees in an anticlockwise direction. As the rotor 60 is rotated in both clockwise and anticlockwise directions, there is less likelihood of wear than if the rotor is only rotated in one direction. Furthermore, the span of rotation is limited to 60 degrees (30 degrees clockwise and 30 degrees anticlockwise), thereby reducing wear of the motor, seals, and other components associated with rotation. The frequency of pressure pulses 5, 6 that can be generated also beneficially increases with a reduced span of rotation of the rotor and, as a result, the data acquisition rate is increased.

It will be evident from the foregoing that provision of more rotor fluid openings 67 will reduce the span of rotation further, thereby increasing the speed of data transmission. The number of fluid openings 67 in the rotor 60 directly correlates to the speed of data transmission. The number of fluid openings 67 is limited by the circumferential area of the rotor 60 being able to accommodate the fluid openings 67 while still maintaining enough structural stability. In order to accommodate more fluid openings 67 if data transmission speed is an important factor, the size of the fluid openings 67 can be decreased to allow for more fluid openings 67 to be present on the rotor 60.

The staged oscillation method can be used to generate a pattern of pressure pulses for fluid pressure pulse generators other than the fluid pressure pulse generator 30 shown in FIGS. 3 to 7. For example the staged oscillation method may be used to generate a first pressure pulse in position 1 and a second pressure pulse in position 2 whereby the first and second pressure pulse are substantially the same size. In this embodiment, the flow of drilling mud through fluid opening(s) in the rotor or stator of the fluid pressure pulse generator is the same or substantially the same in position 1 as in position 2 and is less than the flow of drilling mud through the fluid opening(s) in the start position. For example the stator may include two smaller flow chambers on either side of a larger flow chamber. A fluid opening in the rotor aligns with the larger flow chamber in the start position and aligns with one of the smaller flow chambers in position 1 and with the other smaller flow chamber in position 2. Alternatively, the stator may include walled sections on either side of a flow chamber, which walled sections align with the rotor fluid opening to reduce the flow of drilling mud therethrough in both positions 1 and 2. The innovative aspects of the invention apply equally in embodiments such as these.

Electronics Subassembly

Figure 8:
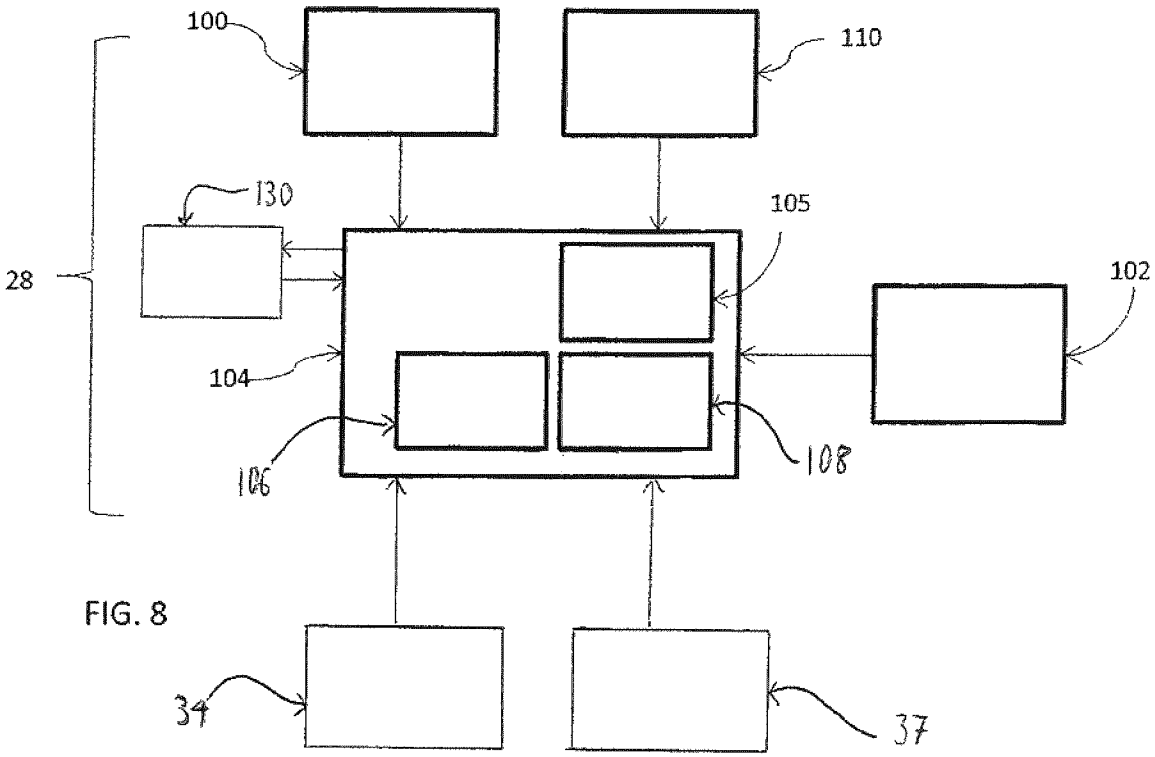
FIG. 8 is a schematic block diagram of components of an electronics subassembly of the pulser assembly.

Referring now to FIG. 8, the electronics subassembly 28 includes components that determine direction and inclination of the drill string, take measurements of drilling conditions, and encode the direction and inclination information and drilling condition measurements (collectively, "telemetry data") into a pulse pattern for transmission by the fluid pressure pulse generator 30. More particularly, the electronics subassembly 28 comprises a directional and inclination (D&I) sensor module 100, drilling conditions sensor module 102, a battery stack 110, a motor driver 130 and a main circuit board 104. The main circuit board 104 contains a data encoder 105, a central processing unit (controller) 106 and a memory 108 having stored thereon program code executable by the controller 106.

The D&I sensor module 100 comprises accelerometers, magnetometers and associated data acquisition and processing circuitry. Such D&I sensor modules are well known in the art and thus are not described in detail here.

The drilling conditions sensor module 102 include sensors mounted on a circuit board for taking various measurements of borehole parameters and conditions such as temperature, pressure, shock, vibration, rotation and directional parameters. Such sensor modules are also well known in the art and thus are not described in detail here.

The motor driver 130 provides three-phase electrical power to the pulse generating motor in the motor and gearbox subassembly 23. The motor driver 130 is electrically communicative with the main circuit board 104 and receives signals from the controller 106 to start and stop the motor so as to maintain the motor in a rotating state or to maintain the motor in a brake state where there is no movement of the motor. The motor driver 130 is provided with a current and voltage sensing circuit which senses electrical input to the motor and sends this information back to the main circuit board 104. Feedback information regarding electrical input to the motor may be utilized by the controller 106 for controlling pressure pulse timing as described below in more detail.

The main circuit board 104 can be a printed circuit board with electronic components soldered on the surface of the board. The main circuit board 104 and the sensor modules 100, 102 may be secured on a carrier device (not shown) which is fixed inside the electronics subassembly housing 33 by end cap structures (not shown). The sensor modules 100, 102 are each electrically communicative with the main circuit board 104 and send measurement data to the controller 106. The controller 106 is programmed to encode this measurement data into a carrier wave using known modulation techniques, then sends control signals to the motor driver 130 to drive the motor and rotate the driveshaft 24 and rotor 60 to generate pressure pulses corresponding to the carrier wave.

The pressure transducer 34 is electrically communicative with the main circuit board 104 and sends pressure measurement data to the controller 106. In addition, a sensor 37 is electrically communicative with the main circuit board 104 and sends motor output signal measurement data to the controller 106. The controller 106 is programmed to process this pressure and motor output signal measurement data and send control signals to the motor driver 130 to control rotation of the motor and thereby control pressure pulse generation timing as will be described in detail below.

In alternative embodiments, the electronics subassembly may not comprise all of the sensor modules 100, 102, pressure transducer 34, and sensor 37, and may comprise additional or alternate sensors communicative with the main circuit board 104. The innovative aspects of the invention apply equally in embodiments such as these.

Motor and Gearbox Subassembly

Figure 13:
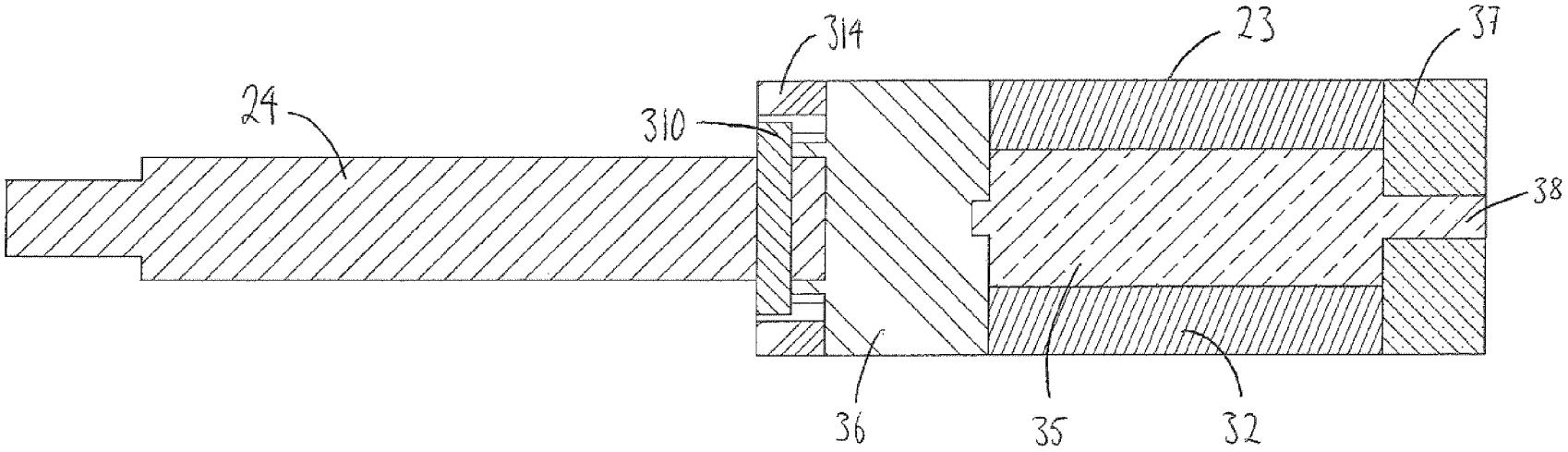
FIG. 13 is a longitudinally section view of the driveshaft and the motor and gearbox subassembly of FIG. 9.

Referring now to FIG. 13, there is shown the motor and gearbox subassembly 23 comprising a motor and a gearbox 36 rotationally coupled with the driveshaft 24. The motor may be a brushless motor as is known in the art and comprises a fixed motor stator 32 and a motor rotor 35 enclosed by the motor stator 32 for rotation therein. The motor rotor 35 includes an output shaft (not shown) at its downhole end which is coupled with the gearbox 36 which in turn is coupled with the driveshaft 24. Rotation of the motor rotor 35 within the fixed motor stator 32 therefore results in rotation of the driveshaft 24 and thus the rotor 60 of the fluid pressure pulse generator 30. The motor and gearbox subassembly 23 also includes a mechanical stop sub-assembly comprising a mechanical stop collar 314 mounted at the downhole end of the motor and gearbox subassembly 23 adjacent the gearbox 36, and a mechanical stop coupling key 310 protruding from the driveshaft 24 and interacting with the mechanical stop collar 314 for precise location and positioning of the rotor 60 relative to the stator 40 of the fluid pressure pulse generator 30. The mechanical stop sub-assembly is described in more detail below under the heading "Mechanical Stop Sub-assembly".

The motor rotor 35 includes an additional uphole shaft 38 at its uphole end opposed to the downhole output shaft. A sensor 37 is coupled with the uphole shaft 38 and detects output signals generated by rotation of the motor rotor 35. The sensor 37 may be an inductive sensor, such as a Hall Effect sensor. Brushless motors with integrated Hall sensors are known in the art, for example the Maxon™ EC motor. Rotating permanent magnets on the brushless motor rotor 35 generate an alternating magnetic field (output signal) that is detected by one or more fixed Hall Effect sensors 37 and this information is transmitted to the controller 106 in the electronics subassembly 28. More specifically, the alternating magnetic field produced by the rotating permanent magnets cause each Hall Effect sensor to vary its output voltage to generate a sensor state as the magnet passes by the fixed Hall Effect sensor. The sensor states are counted to provide an indication of the amount of rotation of the motor rotor 35 and this information is processed by the controller 106 to determine the position of the driveshaft 24 and to control rotation of the driveshaft 24 based on a predetermined rotational relationship between the driveshaft 24 and the motor rotor 35. The predetermined rotation relationship between the driveshaft 24 and the motor rotor 35 may be based on the translation ratio of the gearbox 36 which determines how many revolutions of the motor rotor 35 are required for each revolution of the driveshaft 24. The translation ratio of the gearbox may, for example, be 20:1, 30:1, 40:1, 70:1, 100:1 or any ratio in between such as 30.25:1, 50.5:1, 80.75:1. A method for determining the position of the driveshaft 24 and for controlling rotation of the driveshaft 24 is described below in more detail under the heading "Driveshaft Position Sensing and Control".

The sensor 37 is positioned to surround the uphole shaft 38 of the motor rotor 35 and detects rotation of the motor rotor 35. The sensor 37 is electrically connected to the controller 106 in the electronics subassembly 28 via the feed-through connector 29. This eliminates the need for electrical connections and circuitry between the driveshaft 24 and/or gearbox 36 and the controller 106 in the electronics subassembly 28, which connections are typically cumbersome, take up additional space and may be prone to damage.

In alternative embodiments (not shown) the motor rotor 35 may not include the uphole shaft 38 and the sensor 37 may be associated with the uphole end of the motor rotor 35. In further alternative embodiments, the sensor 37 may not be positioned at the uphole end of the motor rotor 35. In alternative embodiments, the sensor 37 may detect other indicators of motor rotation, for example motor rotor speed, and is not limited to a sensor that detects motor output signals.

Mechanical Stop Sub-Assembly

Figure 9:
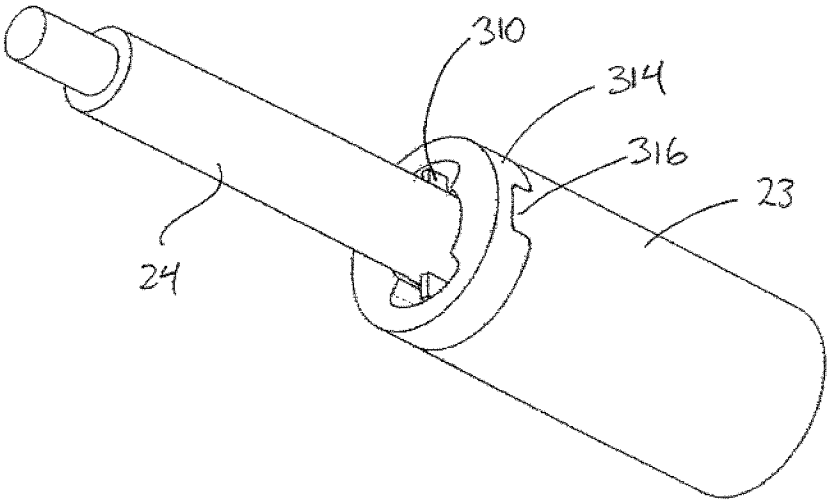
FIG. 9 is a perspective view of a driveshaft and a motor and gearbox subassembly of the pulser assembly including a first embodiment of a mechanical stop sub-assembly.
Figure 10:
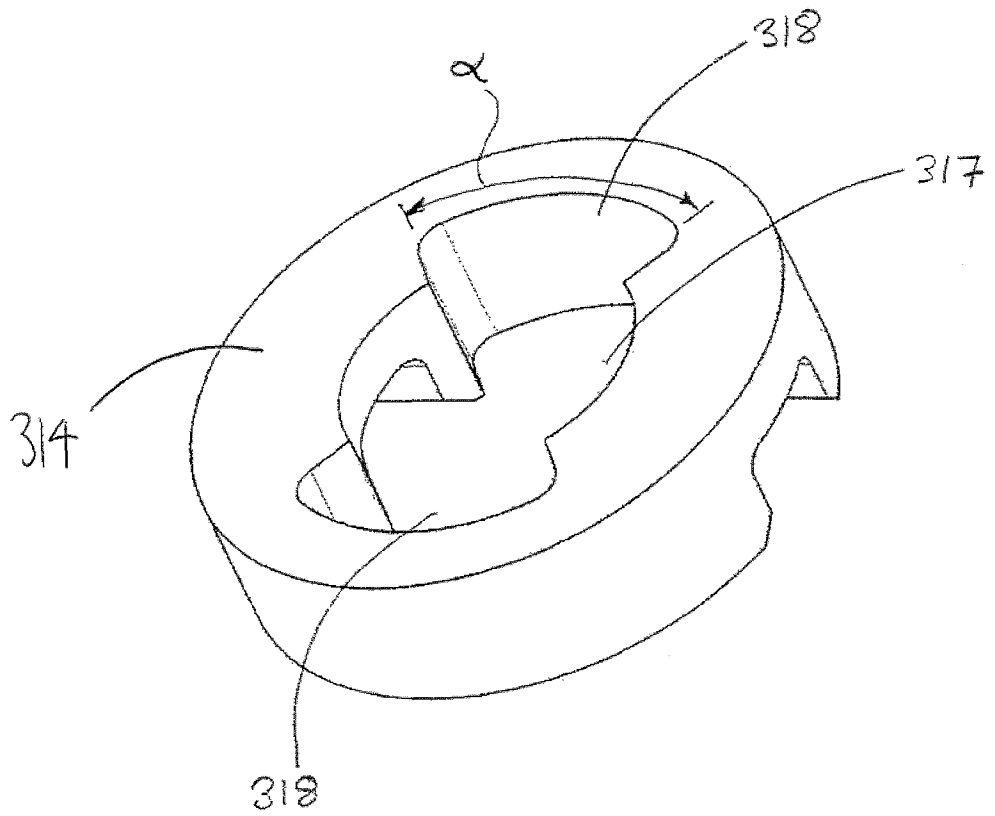
FIG. 10 is a perspective view of a collar of the mechanical stop sub-assembly of FIG. 9.

Referring now to FIGS. 9, 10 and 13 there is illustrated a first embodiment of the mechanical stop sub-assembly of the motor and gearbox subassembly 23 comprising the mechanical stop collar 314. A driveline input indexing tooth 316 protrudes in an axial direction from the downhole end of cylindrical housing of the motor and gearbox subassembly 23 and mates with a notch on the mechanical stop collar 314; this serves to affix and precisely position the mechanical stop collar 314 relative to the housing of the motor and gearbox subassembly 23 and hence the gearbox 36 and motor enclosed within the housing.

The mechanical stop collar 314 comprises an angular movement restrictor window comprising a central window segment 317 for rotatably receiving the driveshaft 24, flanked by two 180° opposed indexing window segments 318 that allow the mechanical stop coupling key 310 protruding from the driveshaft 24 to oscillate within the indexing window segments 318. The angular span a of each indexing window segment 318 is selected to correspond to the desired range of oscillation for the rotor 60 that provides a full range of motion between flow configurations. In this embodiment, the angular span is 60° for both indexing window segments 318, which provides the rotor 60 with the angular range required to rotate between positions 1 and 2 as discussed above under heading "Staged Oscillation Method". However, should the rotor 60 be designed to rotate across a different angular range, the angular span a of the indexing window segments 318 can be adjusted accordingly.

The driveshaft 24 comprises a mechanical stop keyhole (not shown) that is located along the driveshaft 24 at a position that axially aligns with the mechanical stop collar 314. The mechanical stop coupling key 310 extends through the mechanical stop keyhole. The mechanical stop coupling key 310 may also engage the gearbox 36 such that the gearbox 36 is coupled to the driveshaft 24; therefore, the mechanical stop coupling key 310 serves as a coupling means to couple the driveshaft 24 and gearbox 36, as well as a rotor positioning and indexing means ("indexer") as will be described in detail below. Alternatively, another coupling key (not shown) may be provided to couple the gearbox 36 to the driveshaft 24, in which case the mechanical stop coupling key 310 serves only as an indexer.

The coupling key 310 serves as an indexer by being constrained to oscillate between the angular span a defined by the indexing window segments 318; in other words, movement of the coupling key 310 within the indexing window segments 318 provides a mechanical indication of an angular movement limit. When the coupling key 310 is positioned centrally in the indexing window segment 318 as shown in FIG. 9, the rotor 60 will be in the start "zero degree" position, i.e. full flow configuration with zero pressure as described above under heading "Staged Oscillation Method". When the coupling key 310 contacts one side of an indexing window segment 318, the rotor 60 will be positioned at position 1, i.e. rotated 30 degrees counter-clockwise from the full flow configuration ("zero degree" position) to the intermediate flow configuration (position 1). Similarly, when the coupling key contacts the opposite side of the indexing window segment 318, the rotor 60 will be positioned at position 2, i.e. rotated 30 degrees clockwise from the full flow configuration ("zero degree" position) to the reduced flow configuration (position 2). As the two indexing window segments are 180° apart and have the same angular span a, contact by one end of the coupling key 310 against one side of an indexing window segment 318 should result in the other end of the coupling key 310 contacting the opposite side of the other indexing window segment 318.

Figure 11:
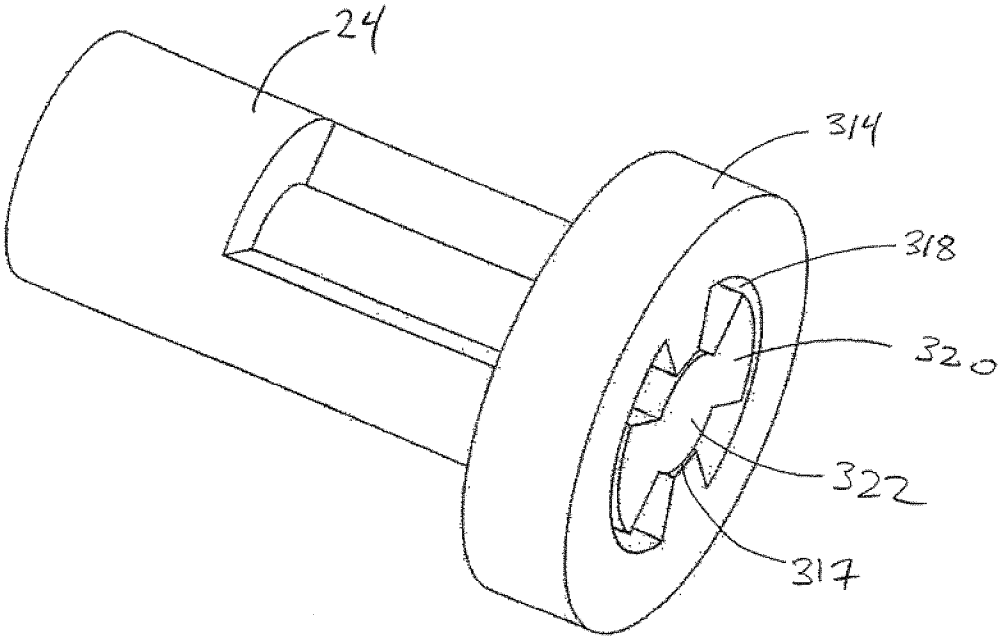
FIG. 11 is a perspective view of a second embodiment of the mechanical stop sub-assembly.

FIG. 11 illustrates an alternative embodiment of the mechanical stop sub-assembly. In this embodiment, the mechanical stop coupling key 310 is replaced by a pair of indexing teeth 320 that are formed directly on the driveshaft 24, e.g. by machining out angular portions of the driveshaft 24 on each side of each indexing tooth 320 to define a smaller diameter circular pin 322 which is rotatable within the central window segment 317 of the mechanical stop collar 314. The indexing window segments 318 and central window segment 317 are reshaped and resized to accommodate the different shape and size of the indexing teeth 320 such that the angular movement of the indexing teeth 320 is 60°.

The angular movement range defined by the indexing window segments 318 provides means for calibrating the fluid pressure pulse generator 30 by determining the centre point of the angular range, which corresponds to the zero degree position of the rotor 60. The driveshaft 24 can be readily positioned at the zero degree position by programming the controller 106 to control the motor driver 130 to drive the motor to rotate the driveshaft 24 such that the mechanical stop coupling key 310 or indexing tooth 320 (collectively "indexer") is positioned at the mid-point of the indexing window segment 318, i.e. move 30° towards the centre after the indexer has made contact with a side of the indexing window segment 318. The memory 108 may be encoded with instructions executable by the controller 106 to move the motor in this manner and monitor motor current feed rate which indicates when contact is made. This provides a simple approach to calibrate the driveshaft 24 angular position at the gearbox output after each oscillation or multiple series of oscillations, with the indexer providing angular movement feedback and without the need for electronic sensors and associated circuitry to track the angular position of the driveshaft 24.

Driveshaft Position Sensing and Control

The position of the driveshaft 24 may be determined using the sensor 37 shown in FIG. 13. The sensor 37 may comprise three Hall Effect sensors that detect the alternating magnetic field (output signals) generated by permanent magnets of a four pole brushless motor. The three Hall Effect sensors therefore generate 12 sensor states for each revolution of the motor rotor 35. If the gearbox 36 has a translation ratio of 30:1, 30 revolutions of the motor rotor 35 equates to 1 revolution of the driveshaft 24. When the angular span for both indexing window segments 318 is 60° as described above, the motor rotor 35 revolves 5 times for rotation of the driveshaft across the 60° angular span to generate 60 sensor states (5 revolutions×12 states=60 states). Each sensor state therefore equates to 1° movement of the driveshaft 24 and thus the rotor 60 fixed to the driveshaft 24. As such, 30 sensor states are generated for the 30° counter-clockwise rotation of the rotor 60 from the full flow configuration ("zero degree" or "start position") to the intermediate flow configuration (position 1). Similarly, 30 sensor states are generated for the 30° clockwise rotation of the rotor 60 from the full flow configuration ("zero degree" or "start position") to the reduced flow configuration (position 2). Should the driveshaft 24 be designed to rotate across a different angular span of the indexing window segments 318, the number of sensor states generated by movement of the driveshaft 24 across the angular span would vary accordingly. Furthermore, in alternative embodiments, the number of Hall Effect sensors provided by sensor 37 and the number of permanent magnets on the brushless motor may vary to generate more or less sensor states per revolution of the motor rotor 35. Also the translation ratio of the gearbox 36 to the motor may be different, for example, the translation ratio of the gearbox 36 may be between 20:1 to 100:1 or any ratio therebetween. In further alternative embodiments, the gearbox 36 need not be present and the driveshaft 24 may be directly connected to the output shaft of the motor rotor 35.

Output signals generated by the motor rotor 35 are detected by the sensor 37 and processed by the controller 106 to provide an indication of the position of the driveshaft 24 and thus the rotor 60 without the need for electrical connections and circuitry between the driveshaft 24 and/or gearbox 36 and the controller 106 in the electronics subassembly 28. In further alternative embodiments, the sensor 37 may detect an alternative indicator of motor rotation in addition to or alternative to detecting motor output signals, for example, the sensor 37 may detect speed of the motor rotor 35.

Figure 12:
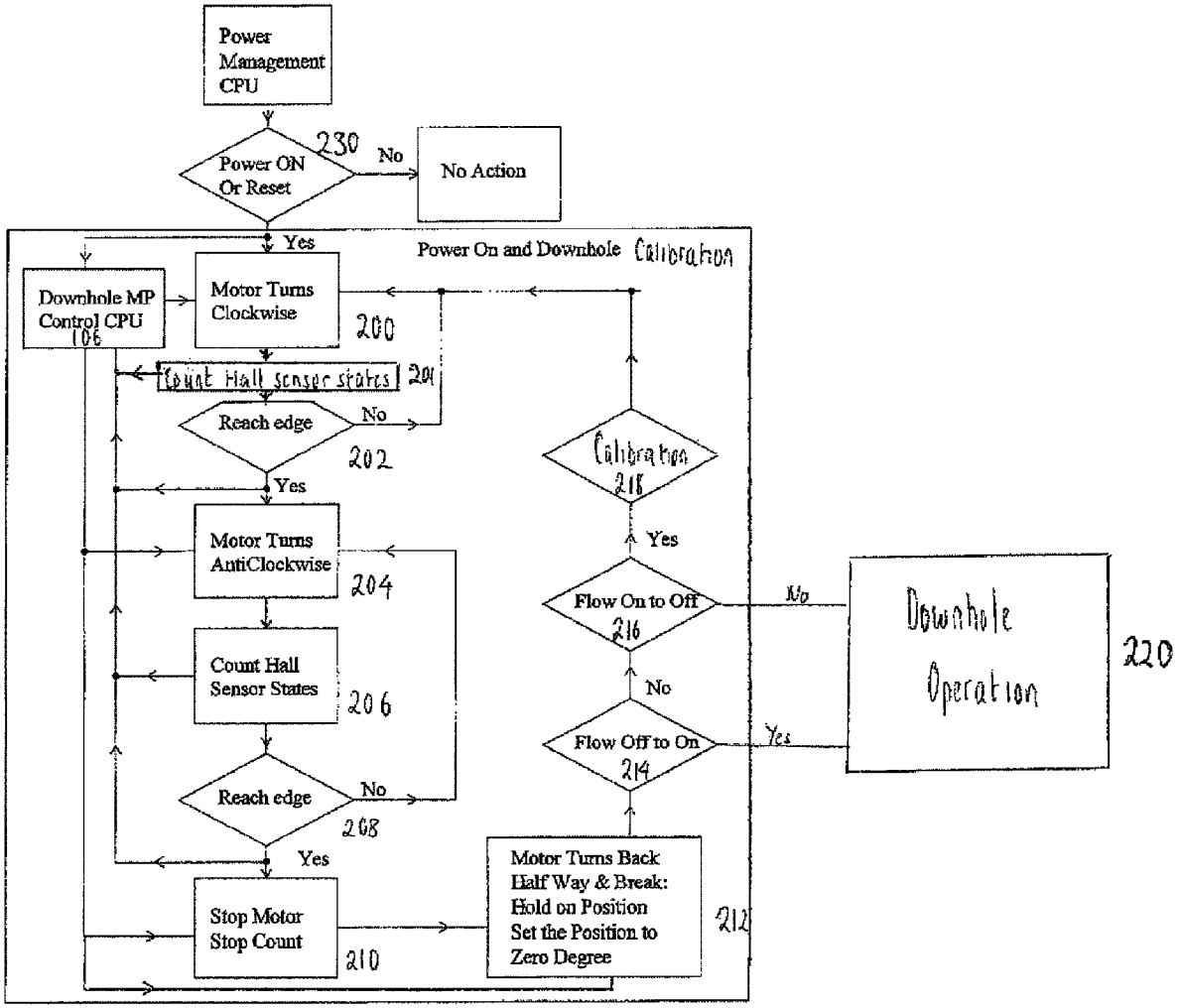
FIG. 12 is a flow chart of steps in a method for calibrating and operating the fluid pressure pulse generator.

Referring now to FIG. 12, method steps are shown for calibrating the fluid pressure pulse generator 30 based on sensing the position of the driveshaft 24 and controlling movement of the driveshaft 24 and thus the rotor 60 of the fluid pressure pulse generator 30. At power on or reset (230) of the MWD tool 20, the controller 106 sends control signals to the motor driver 130 to rotate the motor rotor 35 clockwise (step 200) until the indexer makes contact with a first side of the indexing window segment 318 (step 202) and the rotor 60 is in the reduced flow configuration (position 2). The controller 106 may monitor motor current feed rate to indicate when contact is made. Control signals from the controller 106 to the motor driver 130 switch the direction of rotation of the motor rotor 35 counter-clockwise (step 204) and the motor rotor 35 is rotated until the indexer makes contact with the opposed second side of the indexing window segment 318 (step 208) and the rotor 60 is in the intermediate flow configuration (position 1). Alternatively the motor rotor 35 may be initially rotated counter-clockwise followed by clockwise rotation. Hall Effect sensor states are counted (step 201 and 206) during movement of the indexer and the information sent to the controller 106. Once the indexer makes contact with the second side of the indexing window segment 318 the controller 106 sends a signal to the motor driver 130 to stop rotation of the motor rotor 35 and no more sensor states are generated (step 210). The driveshaft 24 and thus the rotor 60 can readily be positioned at the zero degree/full flow configuration (start position) by calculating the centre point of the angular range based on the number of sensor states counted and rotating the motor rotor 35 to move the indexer to the centre point. Once the centre point is reached, the controller 106 sends a signal to the motor driver 130 to stop rotation of the motor rotor 35 and hold the motor in a brake state where the driveshaft 24 is at zero degree position (step 212). Following calibration of the fluid pressure pulse generator 30 the flow of drilling mud is initiated at the surface and drilling mud is pumped down the drill string (step 214) and downhole operation begins (step 220). When downhole operation ceases the flow of drilling mud is stopped at the surface (step 216). Calibration of the fluid pressure pulse generator 30 (step 218) may be performed using the above described method steps to set the driveshaft 24 and rotor 60 in the zero degree/full flow configuration (start position) before mud flow is next initiated and downhole operation begins again.

Calibration is generally performed when the flow of drilling mud is stopped as there is less resistance to rotation of the rotor 60 and therefore to rotation of the driveshaft 24 and motor rotor 35. With no mud flow, contact of the indexer with the first and second sides of the indexing window segment 318 (step 202 and 208) can be readily detected using feedback from the sensor 37 and motor current feed rate measurements. Calibration can, however, also be performed during the flow of drilling mud if necessary.

During downhole operation, the controller 106 receives motor rotation measurement data from the sensor 37 and may use this information to control rotation and positioning of the driveshaft 24 and thus the rotor 60. For example, sensor states may be detected to indicate the amount of rotation of the driveshaft 24 and rotation of the driveshaft 24 may be controlled so that rotation of the driveshaft 24 is stopped and the direction of rotation changed before the indexer impacts the sides of the indexing window segment 318, which could damage the indexer. Accordingly, it is expected that the rotor 60 can be accurately and reliably positioned at its full flow, intermediate flow and reduced flow configurations, or at its full flow and reduced flow configurations in embodiments where there is no intermediate flow configuration, without the need for electrical connections and circuitry between the driveshaft 24 and control electronics in the electronics subassembly 28. Information from the sensor 37 may also provide an indication that there is a blockage at the fluid pressure pulse generator 30 and may be used to establish the size and positioning of the blockage. For example, when there is restricted movement of the rotor 60 and thus the driveshaft 24 caused by a blockage, the sensor 37 detects that rotation of the motor rotor 35 has correspondingly stopped or slowed down as the number of output signals being generated has slowed down or stopped. The controller 106 can determine the position of the driveshaft 24 and thus the position of the rotor 60 where the blockage occurs based on the number of output signals generated before the blockage and the expected remaining number of output signals that would be generated to move the rotor 60 to the next position. The blockage can therefore be identified.

Method for Controlling Pressure Pulse Timing Using System Feedback

In a method of controlling pressure pulse timing, parameters from systems of the fluid pulse generating apparatus are measured and this data is used to adjust pressure pulse timing to ensure precise hydraulic timing control. The controller 106 located in the electronics subassembly 28 processes the measurement data and sends control signals to the motor driver 130 to control timing of pressure pulses generated by the fluid pressure pulse generator 30. Timing of pressure pulse generation is therefore controlled based on feedback from measurements of prior pulses to provide a dynamic feedback system for controlled pulse timing.

In the embodiment of the fluid pressure pulse generator 30 shown in FIGS. 5 to 7, the rotor 60 can be rotated relative to the fixed stator 40 to provide three different flow configurations, two of which create pressure pulses 5, 6 of different amplitude ("high and low pulse height states") and one which does not create a pressure pulse ("no-pulse height state"). A high amplitude pressure pulse (full pressure pulse 6) having a high peak measured pressure (high pulse height state) corresponds to when the fluid pressure pulse generator 30 is in its reduced flow configuration for a selected default time period, a low amplitude pressure pulse (intermediate pressure pulse 5) having a low peak measured pressure (low pulse height state) corresponds to when the fluid pressure pulse generator 30 is in its intermediate flow configuration for a selected default time period, and no pressure pulse having a constant measured pressure (no pulse height state) corresponds to when the fluid pressure pulse generator 30 is in its full flow configuration. The fluid pressure pulse generator 30 can be operated in a high amplitude pressure pulse mode where the fluid pressure pulse generator 30 is moved between the no pulse height state and the high pulse height state to generate a carrier wave comprising a high amplitude pressure pulse (full pressure pulse 6). The fluid pressure pulse generator 30 can also be operated in a low amplitude pulse mode where the fluid pressure pulse generator 30 is moved between the no pulse height state and the low pulse height state to generate a carrier wave comprising a low amplitude pressure pulse (intermediate pressure pulse 5). The method for controlling pressure pulse timing disclosed herein can also be used for single height fluid pressure pulse generators (not shown) that move between a no pulse height state (full flow configuration) to a single pulse height state (reduced flow configuration) to generate a carrier wave comprising a single height pressure pulse instead of the dual height pressure pulse generators described in the embodiments shown in FIGS. 5 to 7.

In all rotor/stator type fluid pressure pulse generators there is a transition time when the rotor transitions from the full flow configuration (no pulse height state) to the reduced flow configuration (low or high pulse state) and again when the rotor transitions back to the full flow configuration (no pulse height state). For example, in the embodiment described above, the motor revolves two and a half times in one direction to move the driveshaft 24 across the 30° angular span of the indexing window segments 318 to transition from the full flow configuration to the reduced flow configuration and a further two and a half times in the opposite direction to move the driveshaft 24 back to the full flow configuration. The length of this rotor transition time affects the shape of the carrier wave comprising the pressure pulse. There are a number of factors that can influence the rotor transition time and thus the shape of the carrier wave. For example, electrical input to the motor is typically stable but may be adversely affected by extreme temperature changes, thereby affecting the speed of rotation of the motor rotor 35 and influencing the transition time length. Another factor that can influence the transition time length is drilling mud flow rate. As the downhole conditions vary, the flow rate of drilling mud contacting the fluid pressure pulse generator 30 varies and typically corresponds to increased or decreased fluid loads affecting motor speed and thus rotation of the driveshaft 24 and rotor 60. The motor speed will typically slow down with increased fluid load caused by viscous drilling mud conditions downhole and will speed up with decreased fluid load when the drilling mud is less viscous. The transition time length may therefore vary depending on fluid load influences on the motor. Furthermore the transition time from full flow configuration (no pulse height state) to reduced flow configuration (low or high pulse state) (transition time A) may be different to the transition time from reduced flow configuration (low or high pulse state) to full flow configuration (no pulse height state) (transition time B) for a single carrier wave and transition time B can be as much as 2.5 times transition time A. This can result in high variability and uncertainty of pulse timing and can create timing errors during decoding.

The method of controlling pressure pulse timing disclosed herein uses feedback from the sensor 37 associated with the motor rotor 35 to determine the completion of transition of the rotor 60 and controls timing of pressure pulses to offset or correct for the variability and uncertainties of pulse timing caused by variable rotor transition times. The method includes measuring and processing motor output signals detected by the sensor 37 as discussed above under headings "Motor and Gearbox Subassembly" and "Driveshaft Position Sensing and Control". The motor output signals are detected by the sensor 37 and the data is transmitted to the controller 106. The motor output signals provide an indication of motor speed and the amount of rotation of the motor rotor 35 during rotor transition. This information can be used to determine the position of the driveshaft 24 and thus the rotor 60 so that completion of transition of the rotor 60 can be determined. The pressure pulses are timed so that generation of the next pressure pulse occurs only after the previous pressure pulse is complete.

The method for controlling timing of pressure pulses may also include measuring electrical input to the motor rotor 35 and processing this information to provide an indication of motor torque and duration of applied power; this information can be used to determine how much resistance there is to rotor movement during rotor transition. Data regarding electrical input to the motor rotor 35 is sent from the motor driver 130 to the controller 106 and is typically stable but can vary depending on temperature, as well as drilling mud flow rate and viscosity.

The method for controlling timing of pressure pulses may also include measuring pressure of pressure pulses obtained by a downhole pressure transducer, such as the pressure transducer 34 seated in the feed-through connector 29 or any other downhole pressure transducer which measures the pressure of pulses generated by the fluid pressure pulse generator 30. The pressure transducer 34 sends pressure measurement data to the electrically connected controller 106. Feedback from the downhole pressure transducer 34 is processed by the controller 106 and may be used to compute the width, amplitude, duration and centre timing of the physical pressure pulse generated downhole by the fluid pressure fluid pressure pulse generator 30 before attenuation, filtering and distortion of the pulse during travel to the surface. This information may be used to provide a further indication of completion of transition of the rotor 60 and to determine the latency of transition of the generated pressure pulses in the drilling fluid.

The controller 106 uses information from one or more of the measured parameters disclosed above to determine the position of the driveshaft 24 and thus the rotor 60 which indicates when the transition from the full flow configuration (no pulse height state) to the reduced flow configuration (low or high pulse state) and from the reduced flow configuration (low or high pulse state) to the full flow configuration (no pulse height state) are complete and the next transition, or start of pulse, can begin. The controller 106 can modify the timing of control signals being sent to the motor driver 130 based on the feedback information. The controller 106 is able to process the feedback information to dynamically determine the position of the driveshaft 24 and thus the rotor 60 without the need for electrical connections circuitry between the driveshaft 24 or rotor 60 and control electronics in the electronics subassembly 28. Alterations in the start and duration of pulses being generated based on the real time feedback information allows for controlled timing of pulse generation. The timing of the next rotor transition may be controlled to begin sooner or later than scheduled to ensure maximum bandwidth throughput. This may beneficially result in better decoding at the surface and increased confidence in the decoded data due to reduced decoding errors and the ability to fight noise. Stability in timing of pulse generation may also allow pulses to be generated closer together to increase the band width of pulses so that more data can be sent to the surface.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of the general concept. For example, while the MWD tool 20 has generally been described as being orientated with the fluid pressure pulse generator 30 at the downhole end of the tool, the tool may be orientated with the fluid pressure pulse generator 30 at the uphole end of the tool. The innovative aspects of the invention apply equally in embodiments such as these.

The invention claimed is:

1. A fluid pressure pulse generating apparatus comprising:

(a) a pulser assembly comprising: a brushless motor; an inductive sensor for detecting output signals generated by rotation of the motor; a driveshaft rotationally coupled to the motor; processing and motor control equipment communicative with the motor and the sensor; and a mechanical stop sub-assembly comprising a collar fixedly coupled to the motor and at least one indexer protruding from a side of the driveshaft, the collar comprising an angular movement restrictor window with a central window segment which axially and rotatably receives the driveshaft, and an indexing window segment in communication with the central window segment and which receives the indexer, the indexing window segment having an angular span across which the indexer can be oscillated by the driveshaft; and (b) a fluid pressure pulse generator comprising a stator, and a rotor fixedly attached to the driveshaft such that the angular span of the indexing window segment defines the angular range of the rotor's angular movement relative to the stator.

2. The apparatus of claim 1, wherein the inductive sensor comprises a Hall Effect sensor.

3. The apparatus of claim 1, wherein the inductive sensor comprises multiple Hall Effect sensors.

4. The apparatus of claim 1, wherein the pulser assembly further comprises a gearbox coupled with the motor and the driveshaft.

5. The apparatus of claim 1, wherein the brushless motor comprises a motor rotor rotationally mounted in a fixed motor stator, the motor rotor comprising a first end having an output shaft and an opposed second end, whereby the output shaft is rotationally coupled to the driveshaft and the sensor is coupled with the second end.

6. The apparatus of claim 5, wherein the processing and motor control equipment is electrically coupled with the motor and the sensor by at least one electrical interconnection extending therebetween.

7. The apparatus of claim 6, wherein the pulser assembly comprises: a motor subassembly comprising a motor subassembly housing enclosing the motor, the sensor and the driveshaft; an electronics subassembly comprising an electronics subassembly housing enclosing the processing and motor control equipment; and a feed through connector located between the motor subassembly and the electronics subassembly, the feed through connector comprising a body with the at least one electrical interconnection extending axially through the body.

8. A method of calibrating a fluid pulse generating apparatus of claim 1, comprising:

(a) a pulser assembly comprising: a motor; a sensor for detecting rotation of the motor a driveshaft rotationally coupled to the motor: processing and motor control equipment communicative with the motor and the sensor; and a mechanical stop sub-assembly comprising a collar fixedly coupled to the motor and at least one indexer protruding from a side of the driveshaft, the collar comprising an angular movement restrictor window with a central window segment which axially and rotatably receives the driveshaft, and an indexing window segment in communication with the central window segment and which receives the indexer, the indexing window segment having an angular span across which the indexer ran be oscillated by the driveshaft: and (b) a fluid pressure pulse generator comprising a stator, and a rotor fixedly attached to the driveshaft such that the angular span of the indexing window segment defines the angular range of the rotor's angular movement relative to the stator, the method comprising:

(c) rotating the motor to rotate the driveshaft and oscillate the indexer across the angular span of the indexing window segment;

(d) measuring output signals generated by rotation of the motor and detected by the sensor as the indexer oscillates across the angular span, whereby a known number of output signals are generated per revolution of the motor;

(e) determining the number of output signals detected per oscillation of the indexer across the angular span;

(f) calculating the number of output signals that need to be generated by rotation of the motor to rotate the driveshaft from a first position where the indexer is at an edge of the indexing window segment to a calibration position within the angular span from the number of motor output signals detected per oscillation of the indexer across the angular span;

(g) rotating the motor to rotate the driveshaft from the first position to the calibration position and counting output signals generated by rotation of the motor and detected by the sensor during rotation of the driveshaft from the first position to the calibration position; and (h) stopping rotation of the motor when the number of output signals counted equals the calculated number of output signals.

9. The method of claim 8, wherein the calibration position is the central point of the angular span of the indexing window segment whereby the rotor is positioned relative to the stator to flow a drilling fluid in a full flow configuration to produce no pressure pulse.

10. The method of claim 8, wherein the motor is a brushless motor and the output signals comprise an alternating magnetic field.

11. The method of claim 10, wherein the sensor comprises at least one Hall Effect sensor that varies its output voltage in response to the alternating magnetic field to generate a sensor state, and the step of measuring output signals and the step of counting output signals comprising counting sensor states generated by rotation of the motor.

* * * * *